US011046546B2

(12) United States Patent
Imae et al.

(10) Patent No.: US 11,046,546 B2
(45) Date of Patent: Jun. 29, 2021

(54) MEDIUM DISCHARGE DEVICE AND RECORDING APPARATUS

(71) Applicant: SEIKO EPSON CORPORATION, Tokyo (JP)

(72) Inventors: Toshihiro Imae, Matsumoto (JP); Soichiro Kii, Shiojiri (JP); Takafumi Ogimura, Shiojiri (JP); Yasuhiro Matsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 16/259,825

(22) Filed: Jan. 28, 2019

(65) Prior Publication Data

US 2019/0233245 A1 Aug. 1, 2019

(30) Foreign Application Priority Data

Jan. 30, 2018 (JP) ..... JP2018-013829
Oct. 22, 2018 (JP) ..... JP2018-198207

(51) Int. Cl.
*B65H 31/24* (2006.01)
*B65H 31/02* (2006.01)
(Continued)

(52) U.S. Cl.
CPC ..... *B65H 31/24* (2013.01); *B65H 29/58* (2013.01); *B65H 31/02* (2013.01); *B65H 39/11* (2013.01);
(Continued)

(58) Field of Classification Search
CPC ..... B65H 31/32; B65H 31/22; B65H 31/24; B65H 2405/332; B65H 2405/36;
(Continued)

(56) References Cited

U.S. PATENT DOCUMENTS 4,687,191 A 8/1987 Stemmle
4,925,171 A * 5/1990 Kramer ..... B65H 39/11 270/58.14
(Continued)

FOREIGN PATENT DOCUMENTS

JP S57-116645 7/1982
JP S58-131251 9/1983
(Continued)

*Primary Examiner* — Jeremy R Severson
(74) *Attorney, Agent, or Firm* — Workman Nydegger

(57) ABSTRACT

A medium discharge device includes: a discharge unit that discharges a medium; a first medium receiving tray that receives the medium discharged by the discharge unit; and a second medium receiving tray that is provided above the first medium receiving tray in a vertical direction and receives the medium discharged by the discharge unit. The second medium receiving tray is capable of changing a position between an advance position for receiving a medium, which is discharged, by causing at least an upstream zone of the tray including an upstream side end portion in a medium discharge direction to advance to a passing route of the medium from the discharge unit toward the first medium receiving tray and a retraction position to which the upstream zone retracts from the passing route.

12 Claims, 19 Drawing Sheets

(51) Int. Cl.
*B65H 43/06* (2006.01)
*B65H 29/58* (2006.01)
*B65H 39/11* (2006.01)

(52) U.S. Cl.
CPC ..... *B65H 43/06* (2013.01); *B65H 2301/4212* (2013.01); *B65H 2404/1521* (2013.01); *B65H 2404/63* (2013.01); *B65H 2404/725* (2013.01); *B65H 2405/1134* (2013.01); *B65H 2405/11151* (2013.01); *B65H 2405/11162* (2013.01); *B65H 2405/32* (2013.01); *B65H 2405/332* (2013.01); *B65H 2408/11* (2013.01); *B65H 2408/113* (2013.01); *B65H 2801/06* (2013.01); *B65H 2801/15* (2013.01)

(58) Field of Classification Search
CPC ..... B65H 2405/1134; B65H 2408/113; B65H 2408/1131; B65H 39/11; B65H 29/58; B65H 2405/11151; B65H 2801/06; B65H 2405/32
See application file for complete search history.

(56) References Cited

U.S. PATENT DOCUMENTS

| | | | | |
|---|---|---|---|---|
| 5,048,820 A | | 9/1991 | Chung et al. | |
| 5,104,115 A | | 4/1992 | Saito et al. | |
| 6,045,127 A | * | 4/2000 | Fukui ..... | B65H 29/58 271/303 |

FOREIGN PATENT DOCUMENTS

| | | |
|---|---|---|
| JP | H03-042459 | 2/1991 |
| JP | 03-094396 A | 4/1991 |
| JP | H09-183548 | 7/1997 |
| JP | 2002-193533 | 7/2002 |
| JP | 4615050 B | 10/2010 |
| JP | 4749005 B | 5/2011 |
| WO | 2008/032482 A | 1/2010 |

* cited by examiner

MEDIUM DISCHARGE DEVICE AND RECORDING APPARATUS

CROSS REFERENCES TO RELATED APPLICATIONS

The entire disclosure of Japanese Patent Application Nos. 2018-13829, filed Jan. 30, 2018 and 2018-198207, filed Oct. 22, 2018 are expressly incorporated by reference herein.

BACKGROUND

1. Technical Field

The present disclosure relates to a medium discharge device that discharges a medium and a recording apparatus including the medium discharge device.

2. Related Art

In a recording apparatus represented by a printer or the like, a sorter that sorts discharged sheets of paper is installed, in some cases. The sorter may include a plurality of bins disposed in an up-down direction and a sheet transport unit that receives the sheet discharged from the recording apparatus and sends the sheet to any bin. Sorting of the sheets to any bin is performed by a bin fixed type, in which the sheet transport unit moves upward and downward so as to discharge the sheet to any bin, and a bin moving type, in which a position of the sheet transport unit is fixed, and a plurality of bins move upward and downward so as to accommodate the sheet. International Publication No. 2008/032482 discloses an example of the latter type.

When the sorter as described above is included in any types, that is, both the type in which the sheet transport unit moves upward and downward and the type in which the plurality of bins move upward and downward, a configuration of the apparatus increases, and thus the apparatus is likely to increase in size and costs.

SUMMARY

According to an aspect of the disclosure, a medium discharge device includes: a discharge unit that discharges a medium; a first medium receiving tray that receives the discharged medium; and a second medium receiving tray that is provided above the first medium receiving tray in a vertical direction and receives the discharged medium. The second medium receiving tray is capable of changing a position between an advance position for receiving a medium, which is discharged, by causing at least an upstream zone of the tray including an upstream side end portion in a medium discharge direction to traverse a passing route of the medium from the discharge unit toward the first medium receiving tray and a retraction position to which the upstream zone retracts from the passing route.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
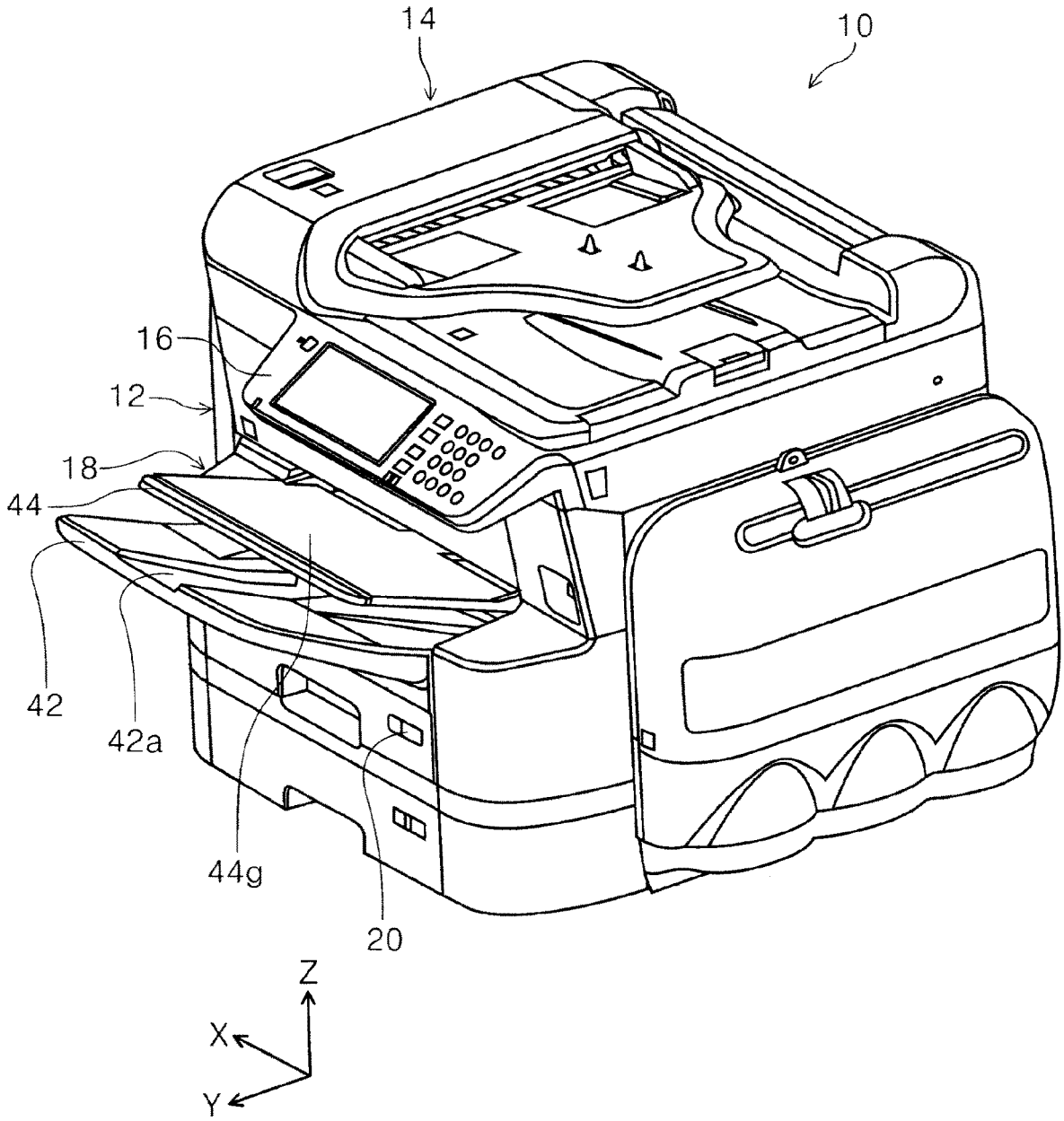
FIG. 1 is a perspective view illustrating the external appearance of a printer according to a first embodiment.

Hereinafter, the disclosure will be schematically described.

According to a first aspect, there is provided a medium discharge device including: a discharge unit that discharges a medium; a first medium receiving tray that receives the medium discharged by the discharge unit; and a second medium receiving tray that is provided above the first medium receiving tray in a vertical direction and receives the medium discharged by the discharge unit. The second medium receiving tray is capable of changing a position between an advance position for receiving a medium, which is discharged, by causing at least an upstream zone of the tray including an upstream side end portion in a medium discharge direction to advance to a passing route of the medium from the discharge unit toward the first medium receiving tray and a retraction position to which the upstream zone retracts from the passing route.

According to the aspect, in a configuration in which the first medium receiving tray and the second medium receiving tray are provided, at least the upstream zone of the second medium receiving tray changes a position, and thereby it is possible to switch a discharge destination of the medium. In other words, since there is no need to employ a configuration in which all of the trays including the first medium receiving tray and the second medium receiving tray move upward and downward, and there is no need to employ a configuration in which the discharge unit moves upward and downward, it is possible to provide the medium discharge device that is capable of sorting media to be discharged, in a simpler configuration, in a small size, and at low costs.

In a second aspect according to the first aspect, the second medium receiving tray is configured to have a downstream zone that is provided to be fixed on a downstream side of the advanceable/retractable upstream zone in the medium discharge direction.

According to the aspect, the second medium receiving tray is configured to have the downstream zone that is provided to be fixed on the downstream side of the advanceable/retractable upstream zone in the medium discharge direction, that is, there is no need for the entire second medium receiving tray to perform a position changing operation, and thus it is possible to avoid an increase in configuration of the apparatus.

In a third aspect according to the second aspect, when the upstream zone of the second medium receiving tray is positioned at the advance position, a medium support surface provided in the upstream zone and a medium support surface provided in the downstream zone are both inclined upward in the same degree with respect to a horizontal toward the medium discharge direction.

According to the aspect, when the upstream zone of the second medium receiving tray is positioned at the advance position, the medium support surface provided in the upstream zone and the medium support surface provided in the downstream zone are both inclined upward in the same degree with respect to the horizontal toward the medium discharge direction, and thus it is possible to appropriately stack media to be discharged, in a natural shape.

In a fourth aspect according to any one of the first to third aspects, the discharge unit is configured of a discharge roller pair that nips and discharges the medium. When the upstream zone of the second medium receiving tray is positioned at the advance position, the upstream zone intersects a tangential line at a nip position of the discharge roller pair.

According to the aspect, the discharge unit is configured of the discharge roller pair that nips and discharges the medium. When the upstream zone of the second medium receiving tray is positioned at the advance position, the upstream zone intersects the tangential line at the nip position of the discharge roller pair. Therefore, it is possible to more reliably stack the media to be discharged from the discharge roller pair in the second medium receiving tray.

In a fifth aspect according to any one of the first to third aspects, the discharge unit is configured of a discharge roller pair that nips and discharges the medium. When the upstream zone of the second medium receiving tray is positioned at the advance position, the upstream side end portion is positioned below a nip position of the discharge roller pair in the vertical direction.

According to the aspect, the discharge unit is configured of the discharge roller pair that nips and discharges the medium. When the upstream zone of the second medium receiving tray is positioned at the advance position, the upstream side end portion is positioned below the nip position of the discharge roller pair in the vertical direction. Therefore, it is possible to more reliably stack the media to be discharged from the discharge roller pair in the second medium receiving tray.

In a sixth aspect according to any one of the first to fifth aspects, a position of the upstream side end portion of the upstream zone in the medium discharge direction is on a more upstream side in the medium discharge direction in a case where the upstream zone is positioned at the advance position than in a case where the upstream zone is positioned at the retraction position.

According to the aspect, the position of the upstream side end portion of the upstream zone in the medium discharge direction is on the more upstream side in the medium discharge direction in the case where the upstream zone is positioned at the advance position than in the case where the upstream zone is positioned at the retraction position, and thus it is possible to more reliably place the medium to be discharged.

In a seventh aspect according to any one of the first to sixth aspects, a medium support surface provided in the upstream zone of the second medium receiving tray is formed into an upward inclined surface toward the medium discharge direction with respect to a horizontal, and an inclination angle of the inclined surface with respect to the horizontal is larger in a case where the upstream zone is positioned at the advance position than in a case where the upstream zone is positioned at the retraction position.

According to the aspect, the medium support surface provided in the upstream zone of the second medium receiving tray is formed into the upward inclined surface toward the medium discharge direction with respect to the horizontal, and the inclination angle of the inclined surface with respect to the horizontal is larger in the case where the upstream zone is positioned at the advance position than in the case where the upstream zone is positioned at the retraction position. Therefore, it is possible to secure a wide space below the upstream zone in the case where the upstream zone is positioned at the retraction position, and thus it is possible to suppress interference of the upstream zone with the discharge of the medium to the first medium receiving tray.

In an eighth aspect according to any one of the first to seventh aspects, when the upstream zone of the second medium receiving tray is positioned at the advance position, a medium support surface provided in the second medium receiving tray and a medium support surface provided in the first medium receiving tray are both inclined upward in the same degree toward the medium discharge direction.

According to the aspect, when the upstream zone of the second medium receiving tray is positioned at the advance position, the medium support surface provided in the second medium receiving tray and the medium support surface provided in the first medium receiving tray are both inclined upward in the same degree toward the medium discharge direction. In this configuration, it is possible to achieve any operation effects of the first to seventh aspects described above.

In a ninth aspect according to any one of the first to eighth aspects, the upstream side end portion of the second medium receiving tray is provided with a regulatory wall that regulates a position of an upstream side end portion of a discharged medium.

According to the aspect, the upstream side end portion of the second medium receiving tray is provided with the regulatory wall that regulates the position of the upstream side end portion of the discharged medium, and thus it is possible to suppress sliding-down of the medium from the second medium receiving tray.

In a tenth aspect according to any one of the first to ninth aspects, a plurality of the second medium receiving trays are provided.

According to the aspect, in the configuration in which the plurality of second medium receiving trays are provided, it is possible to achieve operation effects of the first to tenth aspects described above.

In an eleventh aspect according to any one of the first to seventh aspects and the ninth and tenth aspects, the first medium receiving tray and the second medium receiving tray are disposed radially toward a downstream side in a discharge direction, in a side view of the passing route.

According to the aspect, since the first medium receiving tray and the second medium receiving trays are disposed radially toward the downstream side in the discharge direction, in a side view of the discharge route of the medium, it is possible to save a space for disposing the first medium receiving tray and the second medium receiving tray on the downstream side in the discharge direction, and the configuration can contribute to miniaturization of the apparatus.

According to a twelfth aspect, there is provided a medium discharge device including: a discharge unit that discharges a medium; a first medium receiving tray that receives the medium discharged by the discharge unit; and a second medium receiving tray that is provided above the first medium receiving tray in a vertical direction and receives the medium discharged by the discharge unit. The discharge unit has a first roller and a second roller that is provided to be capable of changing a position around the first roller and nips the medium in cooperation with the first roller, and the second roller changes a position around the first roller, and thereby a discharge destination of the medium is switched to any one of the first medium receiving tray and the second medium receiving tray.

When the second roller changes the position around the first roller, the discharge direction of the medium changes by the first roller and the second roller. According to the aspect, such performance causes the discharge destination of the medium to be switched to any one of the first medium receiving tray and the second medium receiving tray, and thus it is possible to configure the medium discharge device that is capable of sorting media to be discharged, in a simpler configuration, in a smaller size, and at lower costs, compared with a configuration in which the entire discharge unit moves upward and downward.

According to a thirteenth aspect, there is provided a recording apparatus including: a recording unit that performs recording on a medium; and the medium discharge device according to any one of the first to twelfth aspects which discharges the medium on which recording has been performed by the recording unit.

In the aspect, it is possible to achieve the same operation effects as those of any one of the first to twelfth aspects described above in the recording apparatus.

Hereinafter, embodiments will be described with reference to the drawings. The same reference signs are assigned to the same configurations in the embodiments, thus, only one embodiment is described first, and description of the configurations in the following embodiments is omitted.

Figure 2:
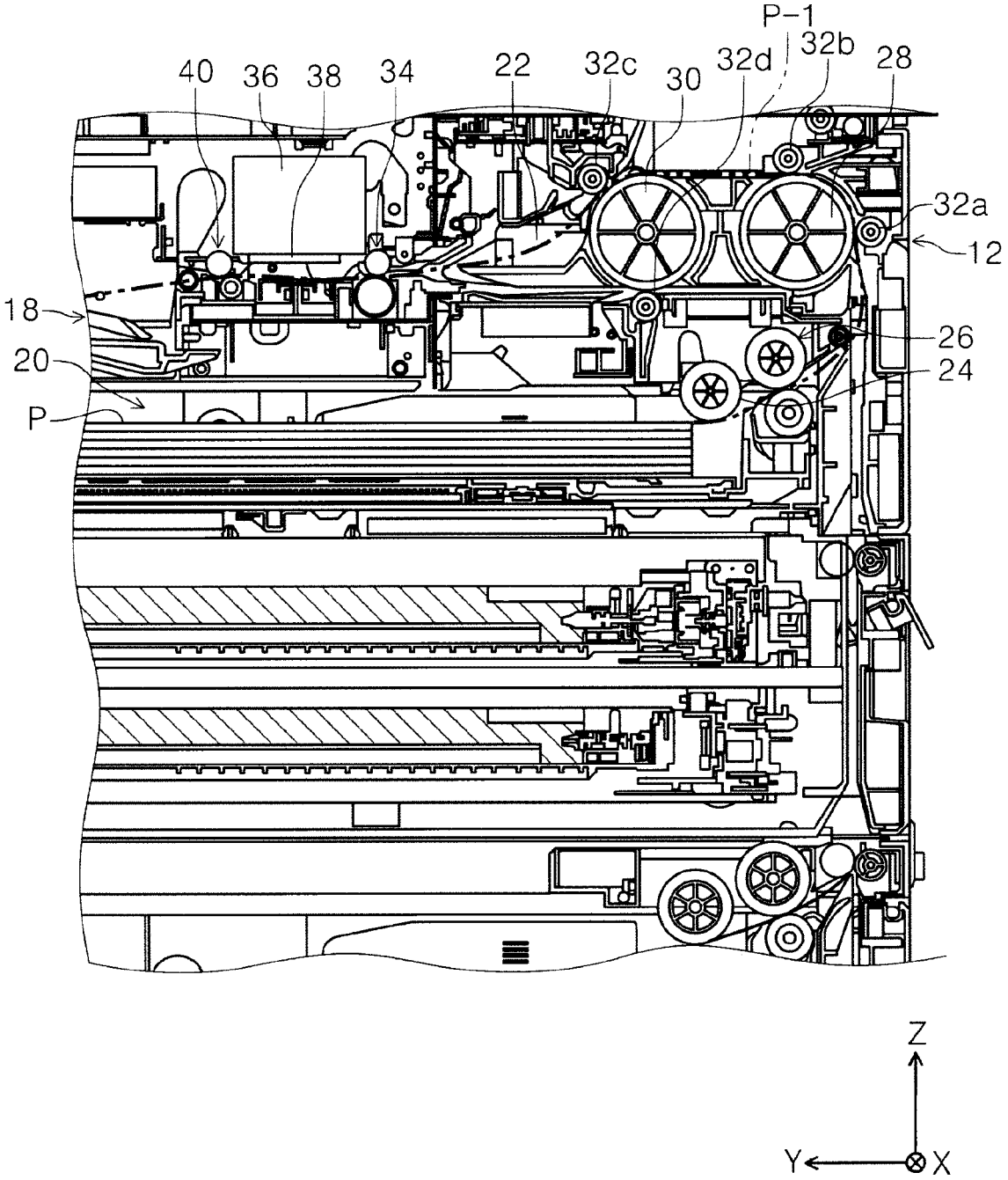
FIG. 2 is a sectional side view illustrating a medium transport route in the printer according to the first embodiment.
Figure 3:
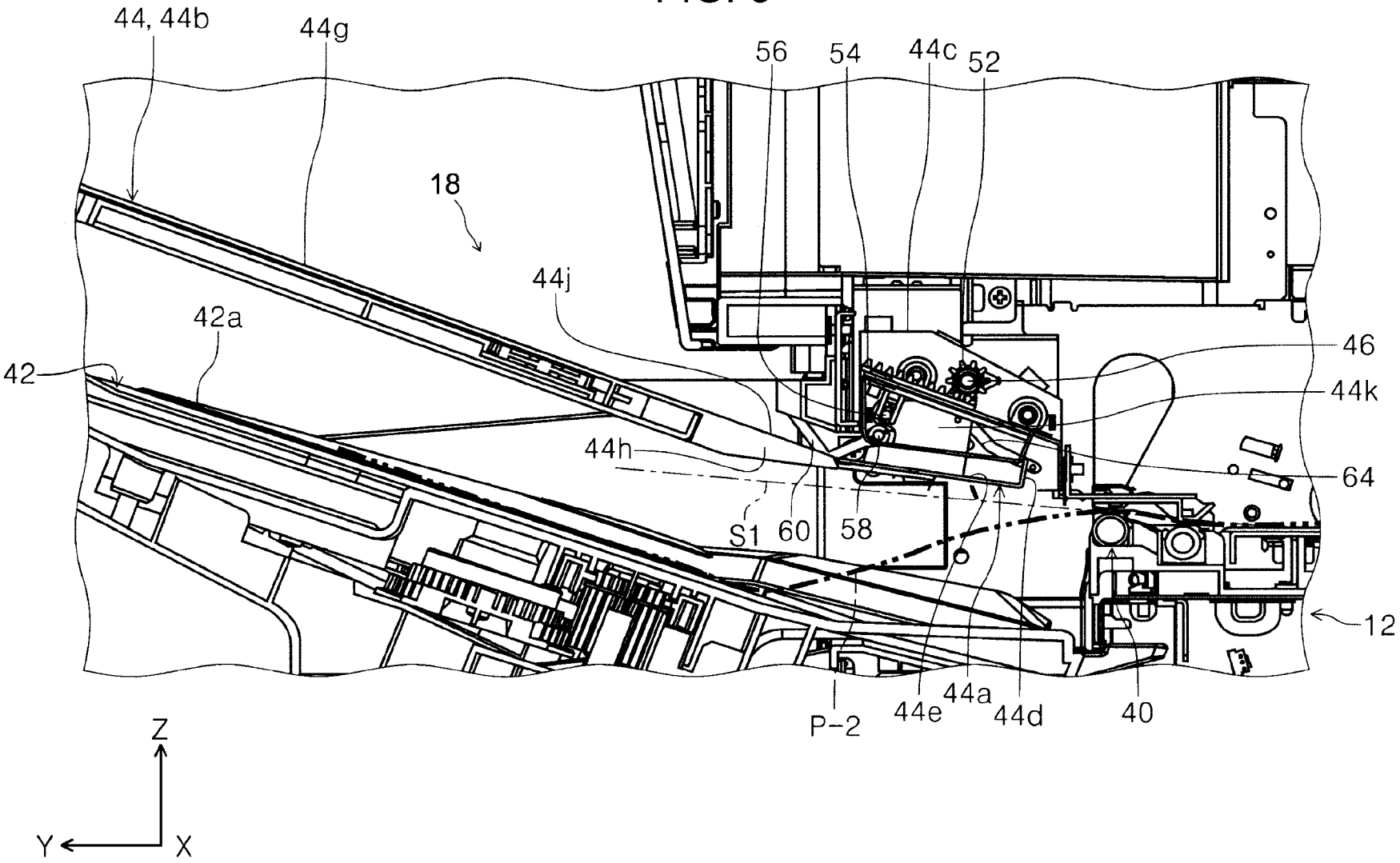
FIG. 3 is a sectional side view illustrating a state in which a medium is discharged to a first medium receiving tray in the first embodiment.

FIG. 1 is a perspective view illustrating the external appearance of a printer according to a first embodiment. FIG. 2 is a sectional side view illustrating a medium transport route in the printer according to the first embodiment. FIG. 3 is a sectional side view illustrating a state in which a medium is discharged to a first medium receiving tray in the first embodiment.

Figure 4:
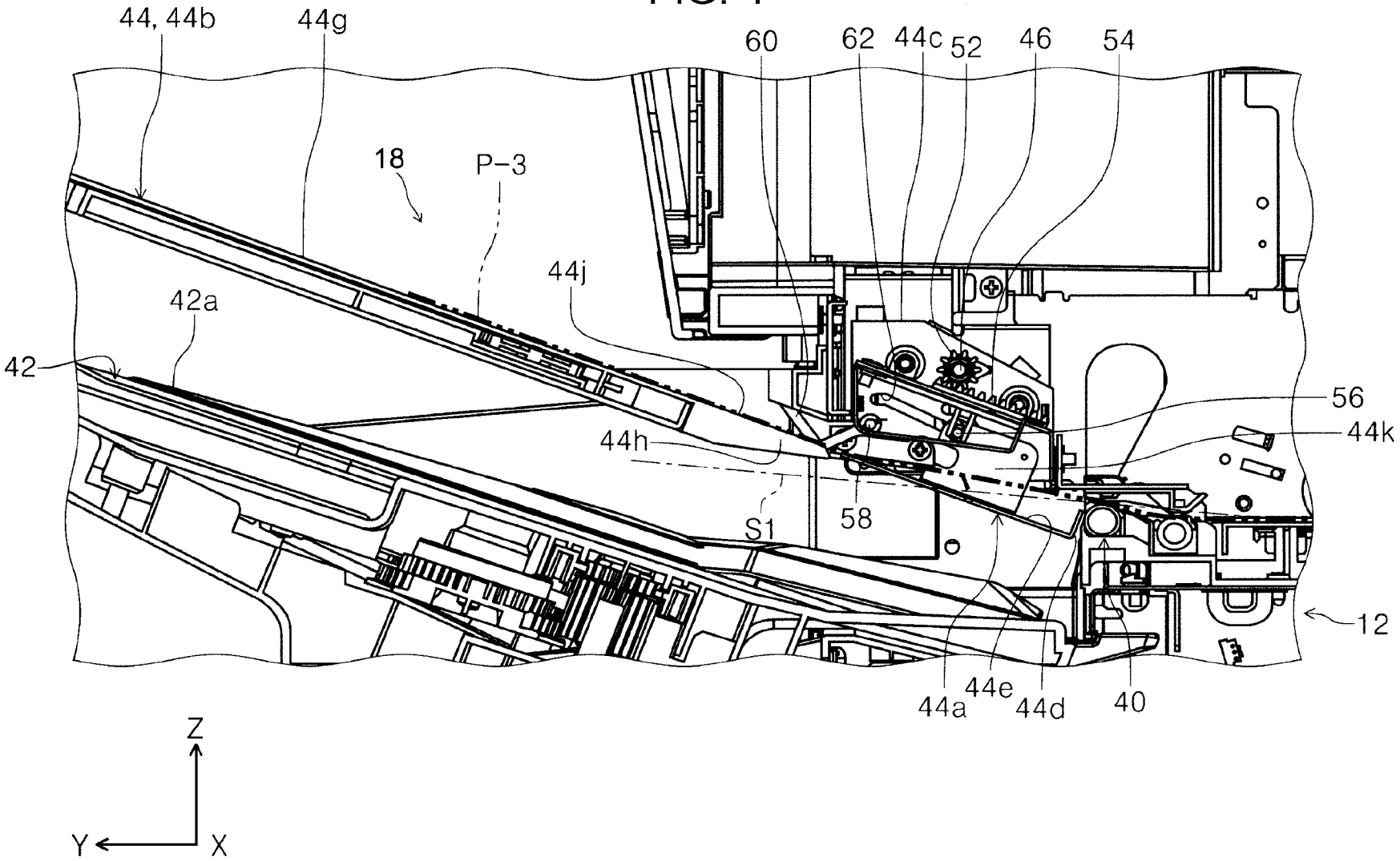
FIG. 4 is a sectional side view illustrating a state in which a medium is discharged to a second medium receiving tray in the first embodiment.
Figure 5:
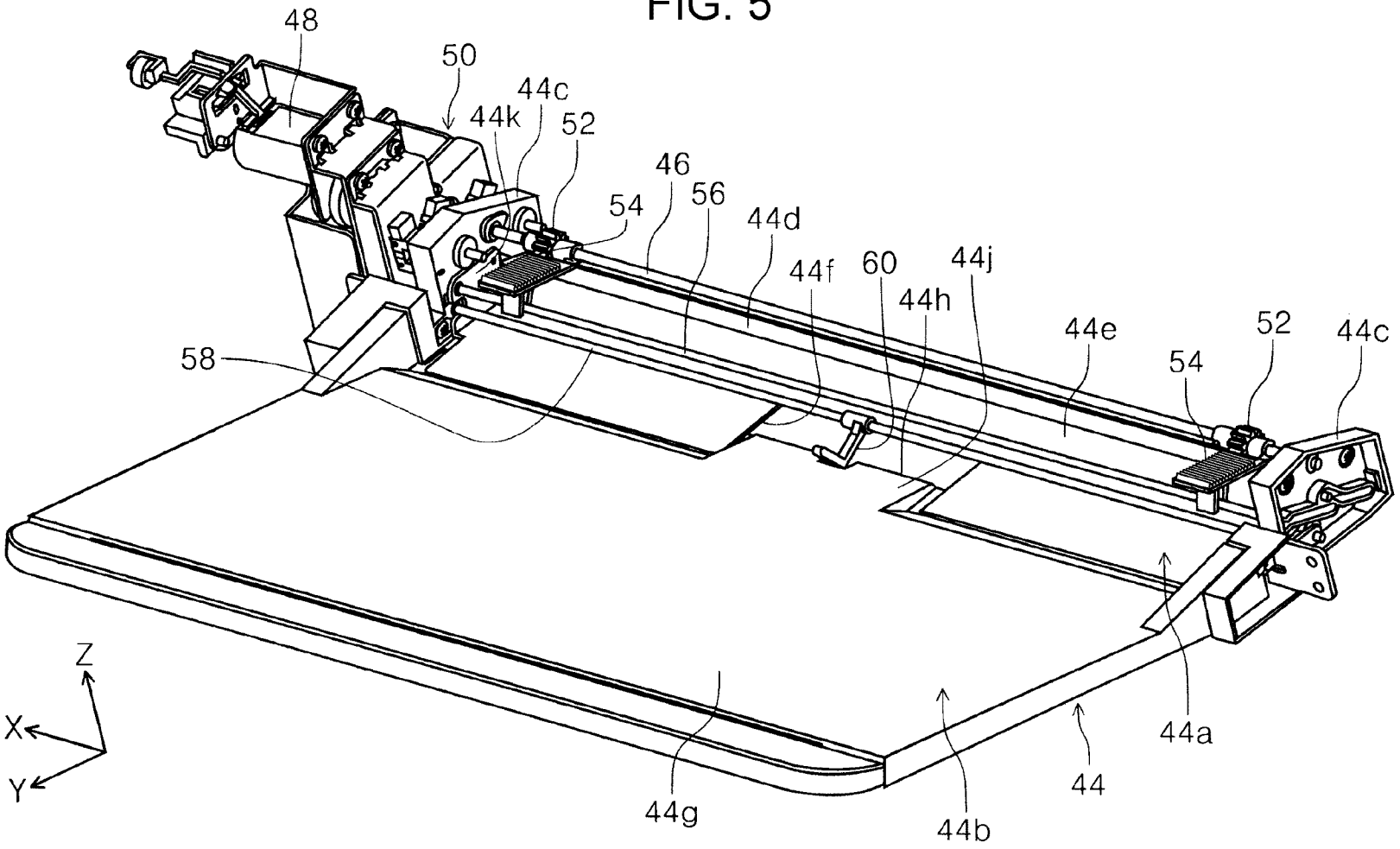
FIG. 5 is a perspective view illustrating a state of the second medium receiving tray at a retraction position.
Figure 6:
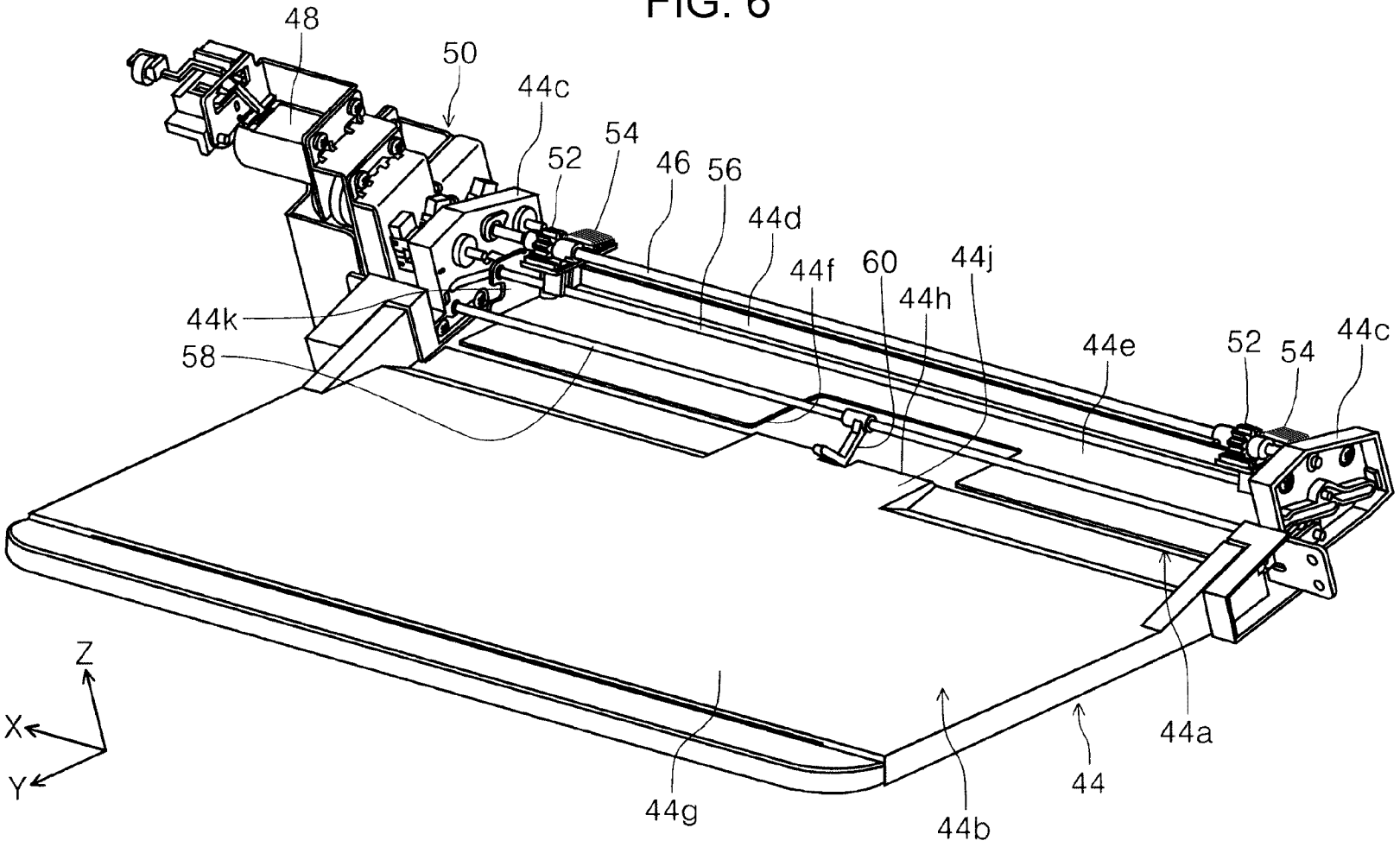
FIG. 6 is a perspective view illustrating a state of the second medium receiving tray at an advance position.

FIG. 4 is a sectional side view illustrating a state in which a medium is discharged to a second medium receiving tray in the first embodiment. FIG. 5 is a perspective view illustrating a state of the second medium receiving tray at a retraction position. FIG. 6 is a perspective view illustrating a state of the second medium receiving tray at an advance position.

Figure 7:
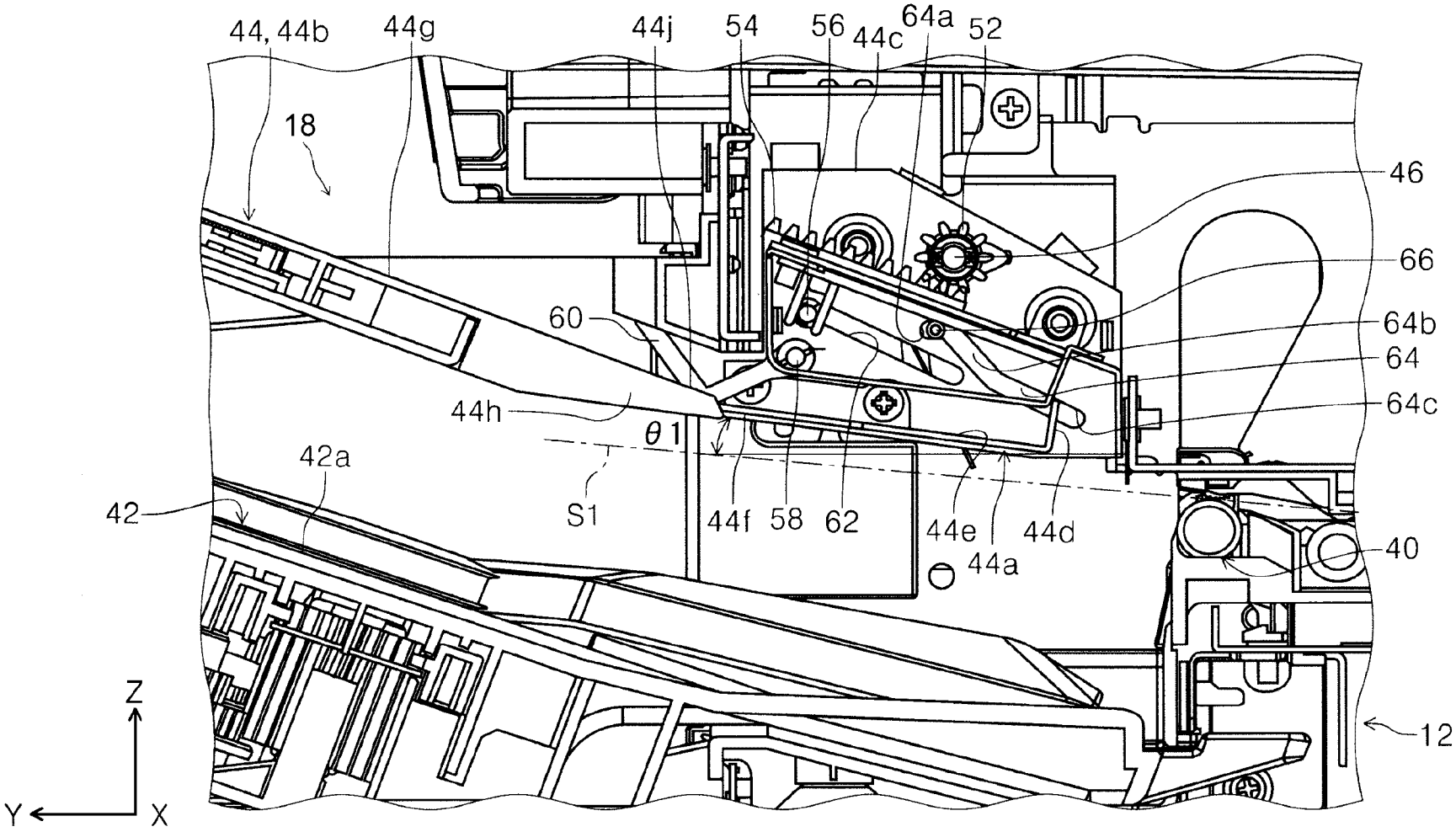
FIG. 7 is a sectional side view illustrating the retraction position of the second medium receiving tray.
Figure 8:
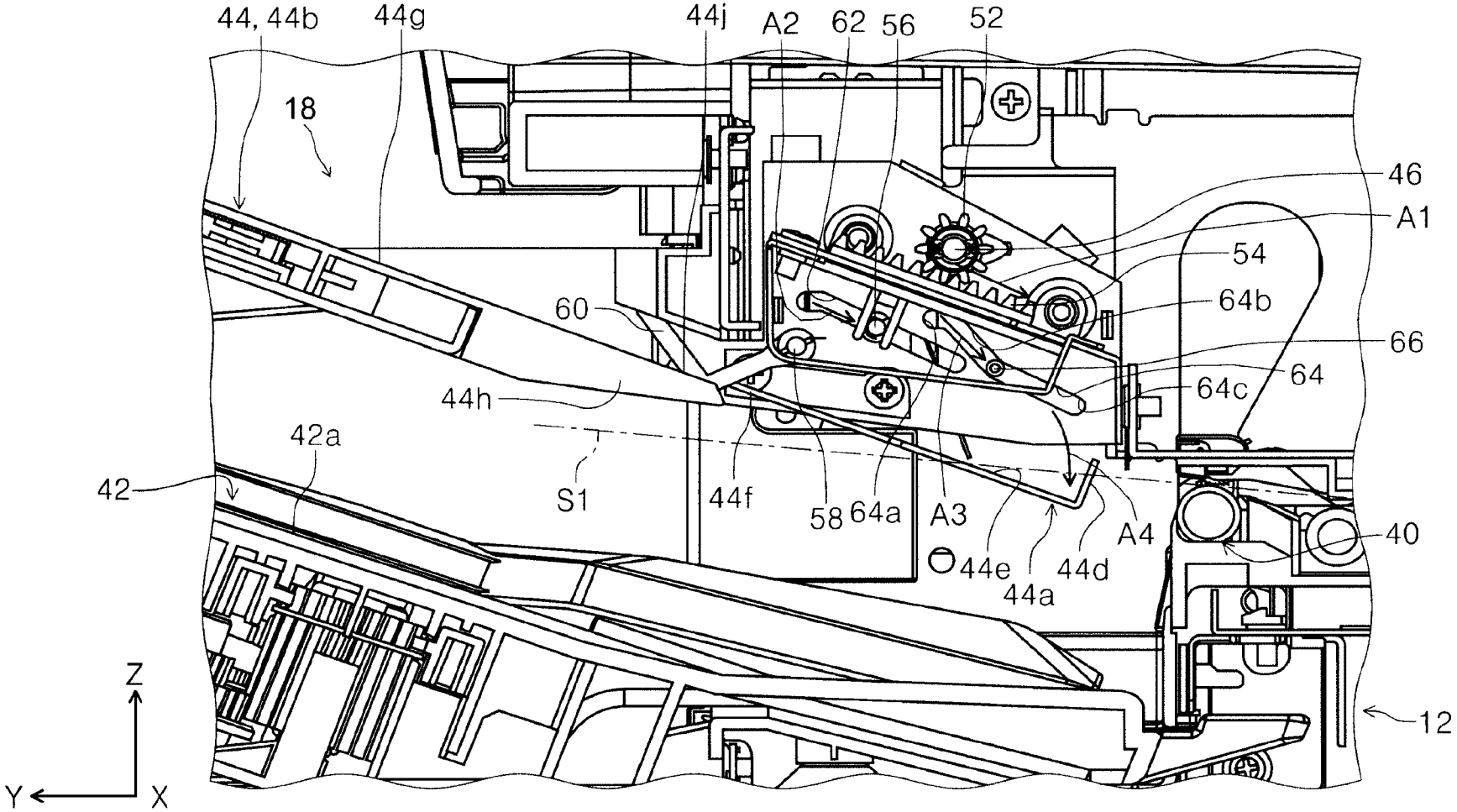
FIG. 8 is a sectional side view illustrating a state in which a position of the second medium receiving tray is switched from the retraction position to the advance position.
Figure 9:
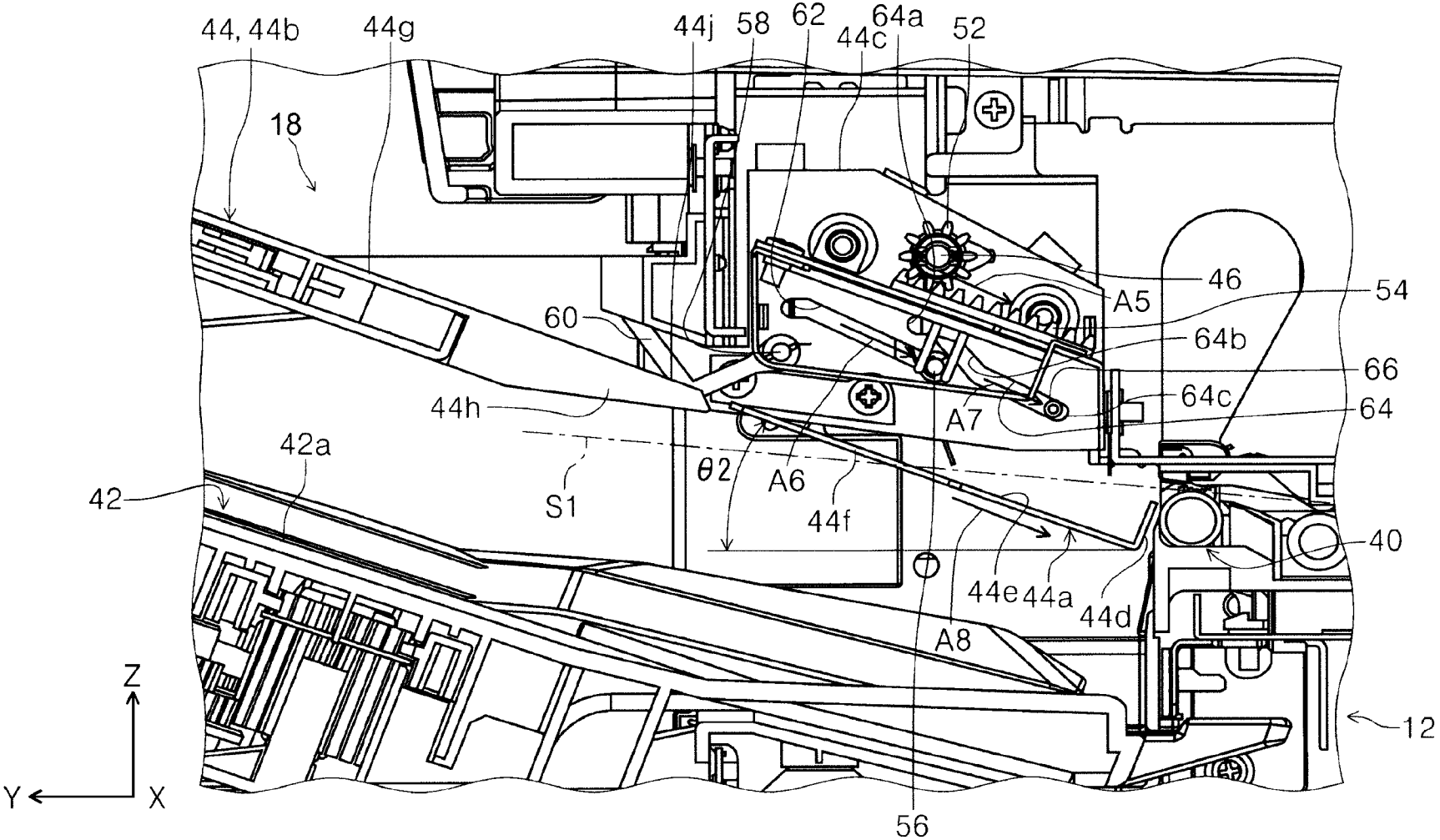
FIG. 9 is a sectional side view illustrating the advance position of the second medium receiving tray.
Figure 10:
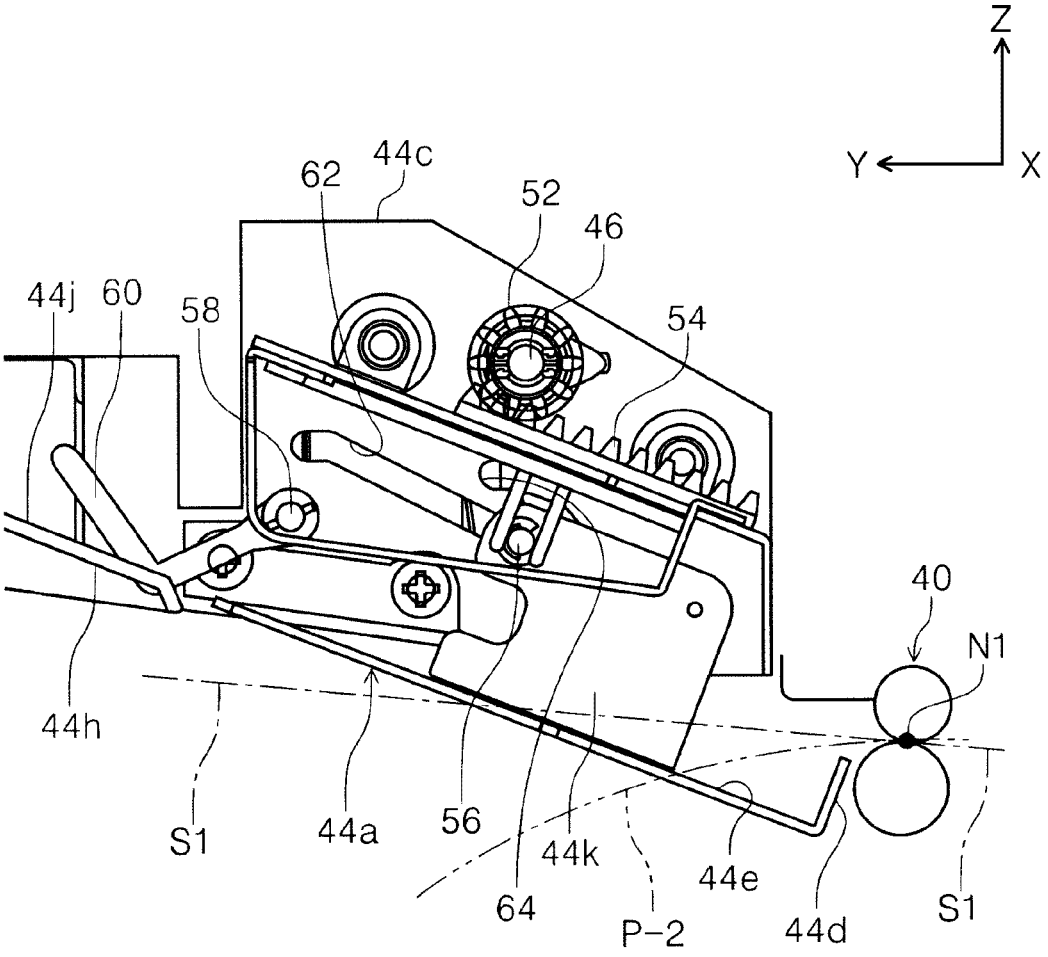
FIG. 10 is a sectional side view illustrating a relationship between the second medium receiving tray and a discharge roller pair at the advance position.

FIG. 7 is a sectional side view illustrating the retraction position of the second medium receiving tray. FIG. 8 is a sectional side view illustrating a state in which a position of the second medium receiving tray is switched from the retraction position to the advance position. FIG. 9 is a sectional side view illustrating the advance position of the second medium receiving tray. FIG. 10 is a sectional side view illustrating a relationship between the second medium receiving tray and a discharge roller pair at the advance position.

Figure 11:
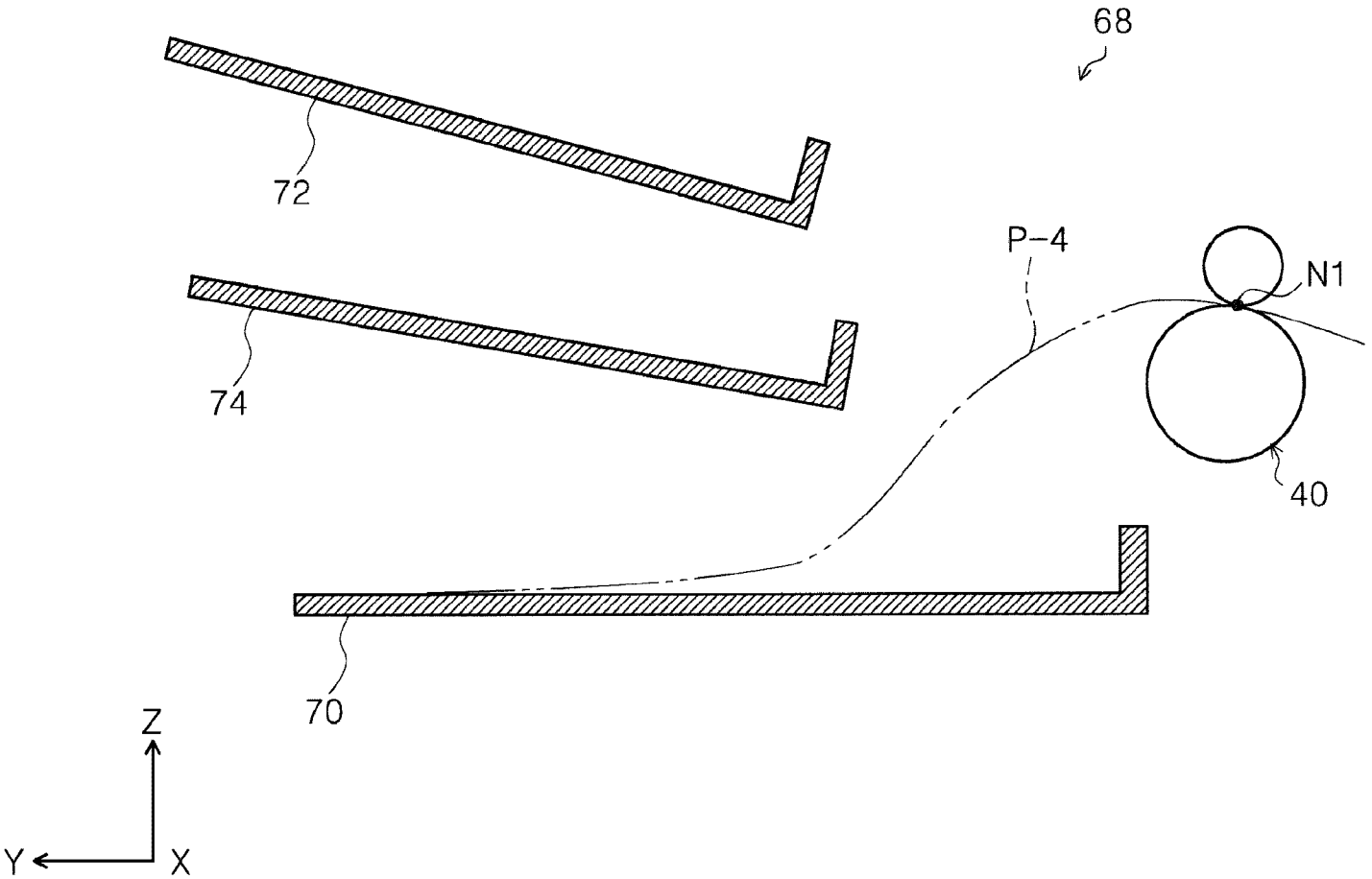
FIG. 11 is a sectional side view illustrating a discharge state to a first medium receiving tray according to a second embodiment.
Figure 12:
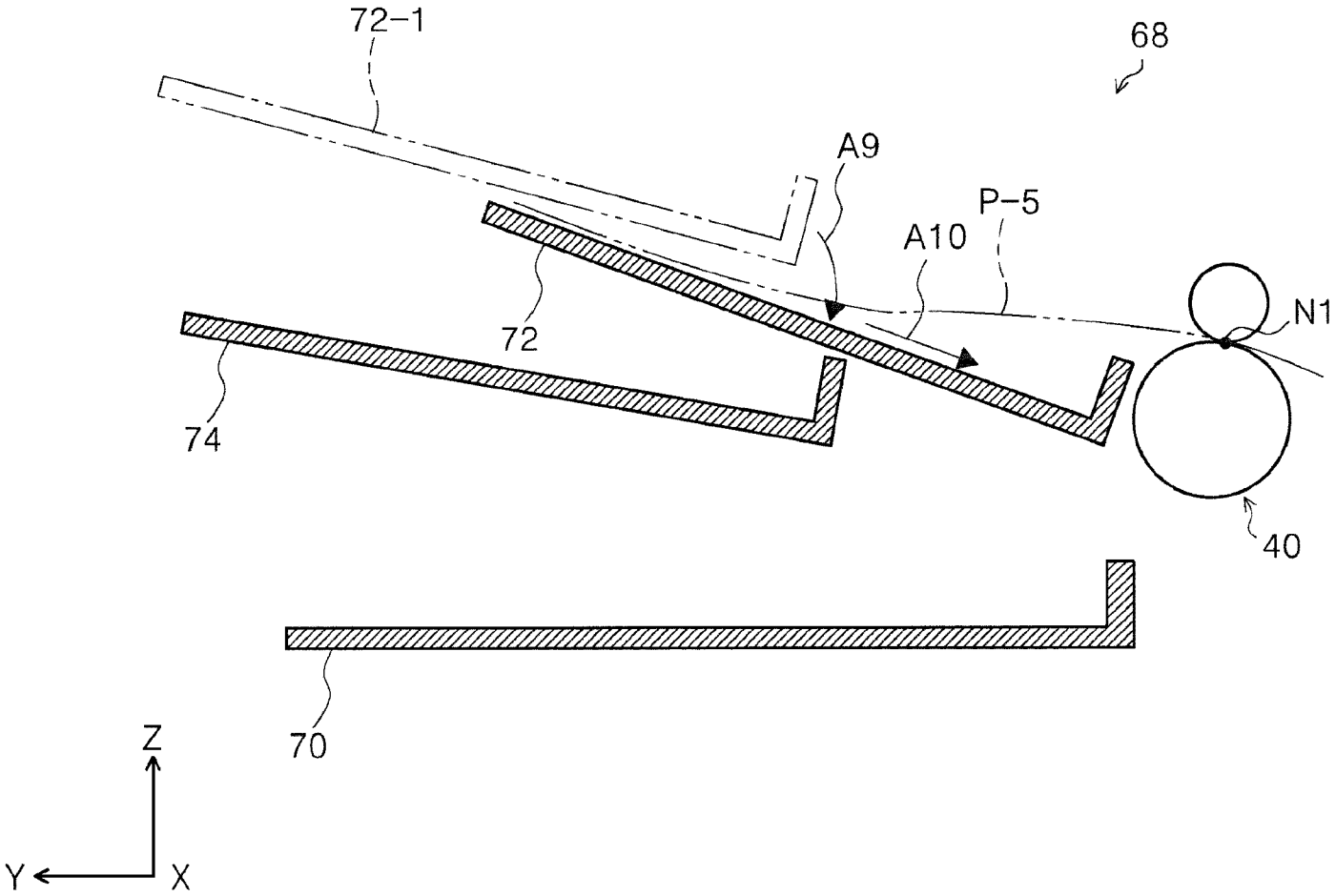
FIG. 12 is a sectional side view illustrating a discharge state to a second medium receiving tray according to the second embodiment.
Figure 13:
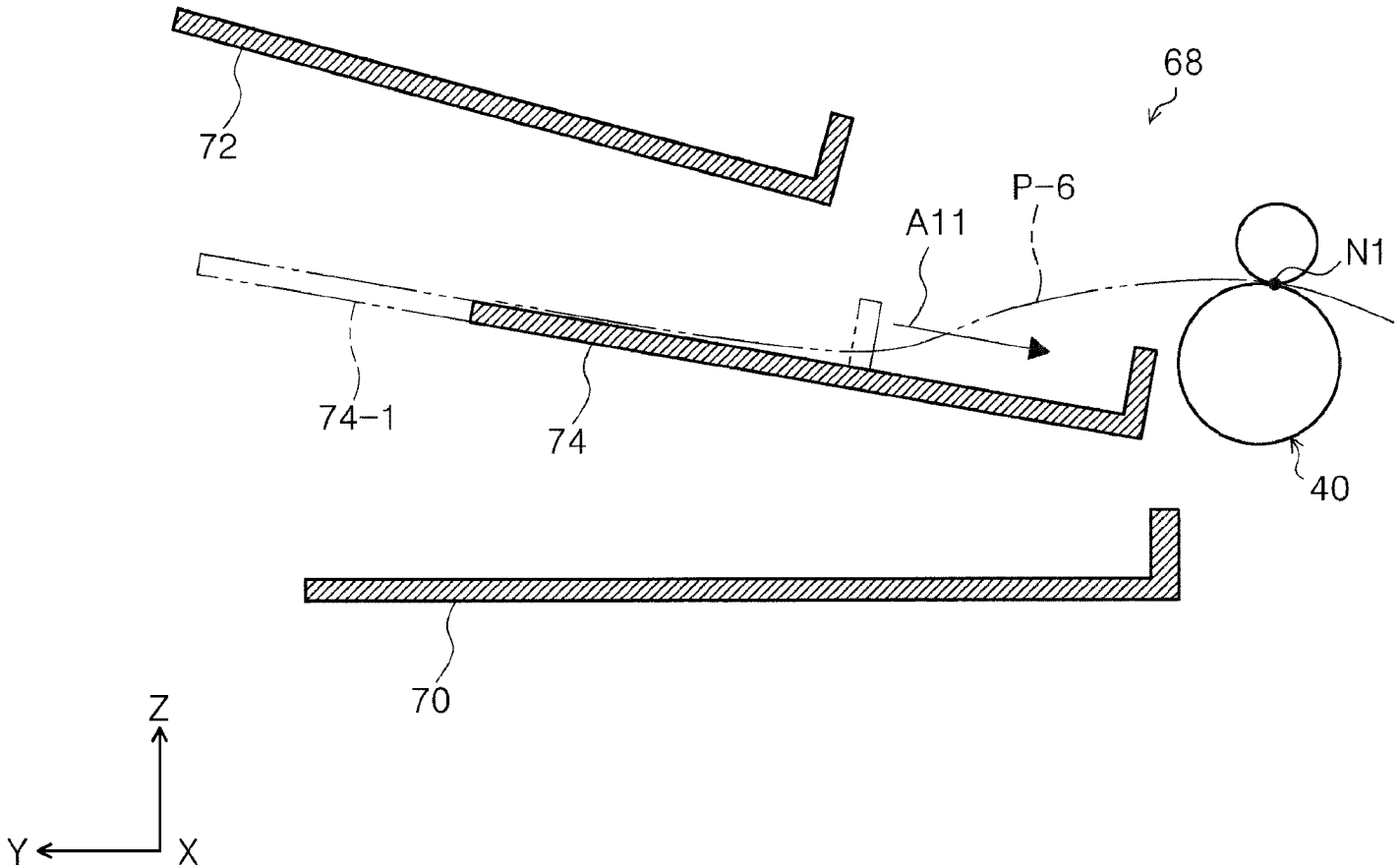
FIG. 13 is a sectional side view illustrating a discharge state to a third medium receiving tray according to the second embodiment.

FIG. 11 is a sectional side view illustrating a discharge state to a first medium receiving tray according to a second embodiment. FIG. 12 is a sectional side view illustrating a discharge state to a second medium receiving tray according to the second embodiment. FIG. 13 is a sectional side view illustrating a discharge state to a third medium receiving tray according to the second embodiment.

Figure 14:
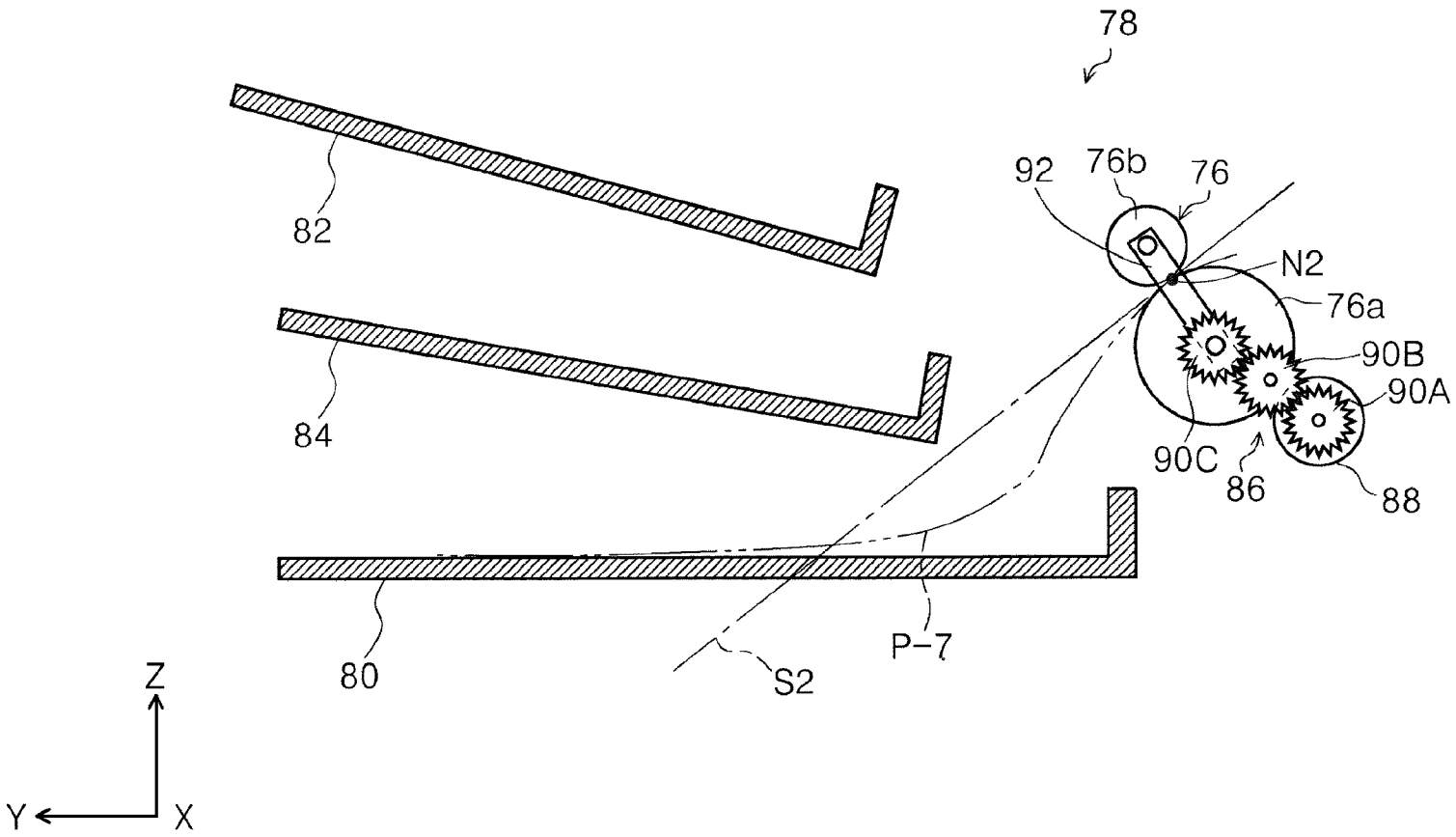
FIG. 14 is a sectional side view illustrating a discharge state to a first medium receiving tray according to a third embodiment.
Figure 15:
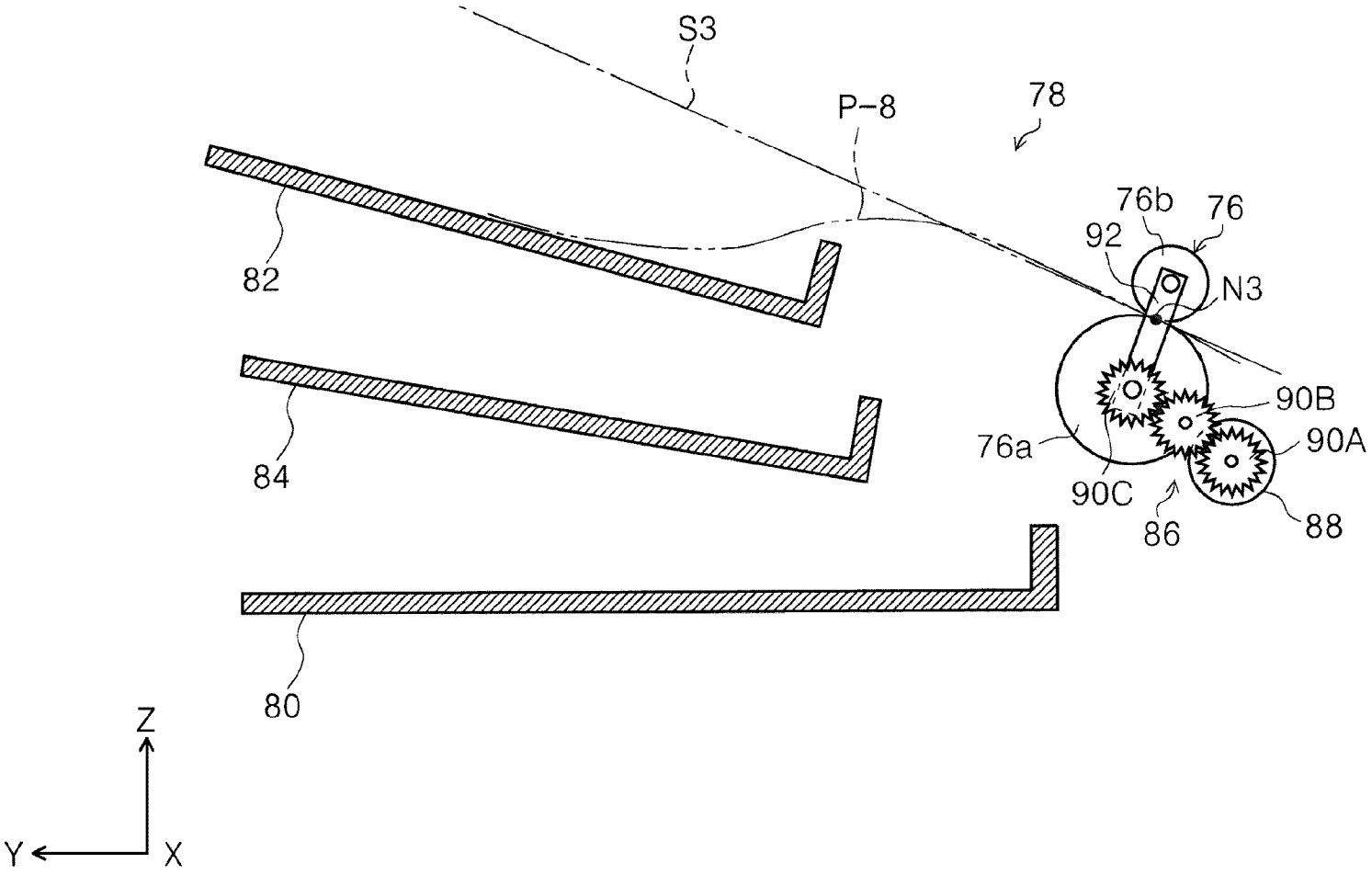
FIG. 15 is a sectional side view illustrating a discharge state to a second medium receiving tray according to the third embodiment.
Figure 16:
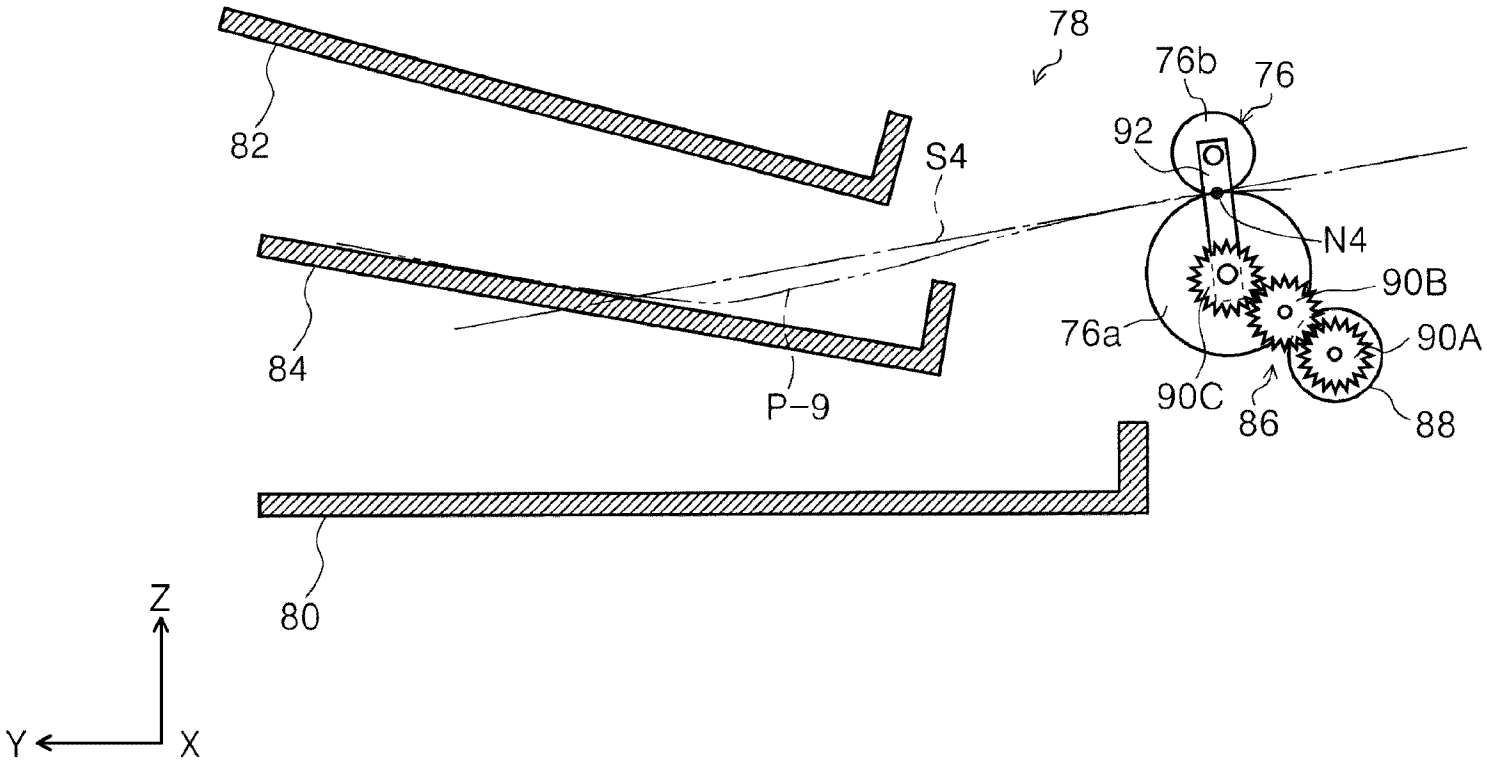
FIG. 16 is a sectional side view illustrating a discharge state to a third medium receiving tray according to the third embodiment.

FIG. 14 is a sectional side view illustrating a discharge state to a first medium receiving tray according to a third embodiment. FIG. 15 is a sectional side view illustrating a discharge state to a second medium receiving tray according to the third embodiment. FIG. 16 is a sectional side view illustrating a discharge state to a third medium receiving tray according to the third embodiment.

In addition, in an X-Y-Z coordinate system in the drawings, an X direction represents a width direction of a recording medium, that is, an apparatus width direction, a Y direction represents a transport direction of the recording medium in a transport route in the recording apparatus, that is, an apparatus depth direction, and a Z direction represents an apparatus height direction.

In the embodiment an X-Y plane is a horizontal plane. In addition, an X-Z plane and a Y-Z plane are vertical.

First Embodiment

Overview of Printer

In FIG. 1, a printer 10 as the "recording apparatus" is configured as a multifunction printer including an apparatus main body 12 and an image reading device 14. The printer 10 is described as an ink jet printer as an example of the recording apparatus; however, the printer may be a recording apparatus such as a laser printer. In addition, the image reading device 14 includes a scanner, a FAX, or the like.

An operating unit 16 is provided on the apparatus main body 12 on a +Y-axis direction side thereof. The operating unit 16 is configured to have a power button, a print setting button, a display button, or the like for operating the printer 10. A medium discharge device 18 is provided on a −Z direction side of the operating unit 16 on the +Y-axis direction side of the apparatus main body 12. The medium discharge device 18 will be described below.

A medium accommodating unit 20 is provided on a −Z direction side of the medium discharge device 18 in the apparatus main body 12. The medium accommodating unit 20 is configured to be capable of accommodating a plurality of media in the inside thereof and being attachable to and detachable from the apparatus main body 12 from the +Y direction side of the apparatus main body 12.

Regarding Medium Transport Route

Subsequently, a medium transport route 22 of the medium P in the printer 10 in FIG. 2 will be described. The medium accommodating unit 20 accommodates a plurality of media P. The media in the embodiment include media having different sizes such as a sheet of paper of A4 size or B5 size, photo paper, or a postcard. A two-dot chain line assigned with a reference sign P-1 in FIG. 2 represents a route of the medium P that is transported along the medium transport route 22.

A first feed roller 24 that is rotatably driven by a drive source (not illustrated) is provided on a +Z direction side of the medium accommodating unit 20. In this manner, when the first feed roller 24 feeds the medium P accommodated in the medium accommodating unit 20 to a downstream side on a transport route, the first feed roller comes into contact with the uppermost medium accommodated in the medium accommodating unit 20 so as to rotate, thereby feeding the uppermost medium to the downstream side in a feed direction from the medium accommodating unit 20. A feed roller pair 26 is provided on the downstream side of the first feed roller 24.

A first transport roller 28 and a second transport roller 30 are provided on the downstream side of the feed roller pair 26 in the feed direction. A plurality of driven rollers 32*a*, 32*b*, 32*c*, and 32*d* are provided around the first transport roller 28 and the second transport roller 30 so as to be rotatably driven with respect to the first transport roller 28 and the second transport roller 30. In addition, a transport roller pair 34 is provided on the downstream side of the first transport roller 28 and the second transport roller 30 in the transport direction.

A carriage 36 is provided on the downstream side of the transport roller pair 34 in the transport direction. The carriage 36 is configured to be capable of reciprocating in an apparatus width direction by a drive unit (not illustrated). A recording head 38 as a "recording unit" is provided in a lower portion of the carriage 36. An underside of the recording head 38 is provided with a plurality of nozzles, and the recording head is configured to be capable of ejecting ink toward the medium P. In addition, a discharge roller pair 40 as a "discharge unit" is provided on the downstream side of the carriage 36 in the transport direction.

The medium P fed by the first feed roller 24 from the medium accommodating unit 20 is transported to a region facing the recording head 38 through the first transport roller 28, the second transport roller 30, and the transport roller pair 34. In this manner, after the recording is executed by the recording head 38, the medium P is discharged to a side surface side of the apparatus by the discharge roller pair 40.

Regarding Medium Discharge Device

The medium discharge device 18 will be schematically described with reference to FIGS. 3 and 4. The medium discharge device 18 in the embodiment includes the discharge roller pair 40, a first medium receiving tray 42, and a second medium receiving tray 44. The first medium receiving tray 42 in the embodiment projects from an end portion of the printer 10 on the +Y direction side toward the +Y direction side as illustrated in FIG. 1. The first medium receiving tray 42 is configured to be inclined in the +Z direction (upward) toward the +Y direction side. The first medium receiving tray 42 is provided with a medium support surface 42*a*. The first medium receiving tray 42 is disposed to be inclined with respect to the apparatus main body 12 at a suitable angle so as to be capable of appropriately placing the medium P discharged to the medium support surface 42*a*.

The second medium receiving tray 44 is provided on the +Z direction side of the first medium receiving tray 42, that is, the second medium receiving tray 44 is provided above the first medium receiving tray 42 in the vertical direction. The description that "the second medium receiving tray 44 is provided above the first medium receiving tray 42 in the vertical direction" is provided by focusing only on a positional relationship in the vertical direction. Specifically, the meaning thereof is not limited to a configuration in which the second medium receiving tray 44 is provided right above the first medium receiving tray 42, but also includes such a case where the second medium receiving tray 44 is not provided right above the first medium receiving tray 42. That is, this means that a positional relationship of the first medium receiving tray 42 and the second medium receiving tray 44 in the Y-axis direction and a positional relationship thereof in an X-axis direction are meaningless.

In the embodiment, the first medium receiving tray 42 is fixed to the medium discharge device 18. "Fixing" in the embodiment means that the first medium receiving tray 42 is not configured to move upward and downward like the sorter when the medium P is discharged. In the embodiment, the first medium receiving tray 42 may be configured to be attachable to and detachable from the medium discharge device 18 so as to be assembled or replaced.

A two-dot chain line assigned with a reference sign P-2 in FIG. 3 represents a discharge route of the medium P that is discharged to the first medium receiving tray 42 by the discharge roller pair 40, a two-dot chain line assigned with a reference sign P-3 in FIG. 4 represents a discharge route of the medium P that is discharged to the second medium receiving tray 44 by the discharge roller pair 40, and a dot-and-dash line assigned with a reference sign S1 in FIGS. 3 and 4 represents a tangential line at a nip position N1 (FIG. 10) in the discharge roller pair 40.

In the embodiment, a passing route (discharge route) of the medium P, which is represented by P-2 or P-3 in FIGS. 3 and 4 is only an example and varies depending on a rotation speed of the discharge roller pair 40, a type of medium P, a landing state of ink to the medium, or the like.

In the embodiment, the second medium receiving tray 44 is configured to advance to the passing route (discharge route P-2) of the medium P to be discharged from the discharge roller pair 40 toward the first medium receiving tray 42 and traverses the passing route (discharge route P-2) so as to be capable of switching the position between the advance position (FIG. 4) for receiving the medium P to be discharged and the retraction position (FIG. 3) to which the second medium receiving tray retracts from the passing route (discharge route P-2) of the medium P to be discharged from the discharge roller pair 40 toward the first medium receiving tray 42.

Regarding Configuration of Second Medium Receiving Tray

A configuration of the second medium receiving tray 44 is described with reference to FIGS. 5 to 10. The second medium receiving tray 44 is provided with an upstream side zone 44*a* as an "upstream zone" in a medium transport direction, a downstream side zone 44*b* as a "downstream zone", and a pair of frames 44*c*. The frame 44*c* in the embodiment is disposed in both side portions of the second medium receiving tray 44 in the X-axis direction. The upstream side zone 44*a* is attached so as to be capable of changing a posture or a position thereof with respect to the frame 44*c* (FIGS. 5 and 6). The downstream side zone 44*b* is provided to be fixed to the frame 44*c*. "Fixing" in the embodiment means that the first downstream side zone 44*b* is not configured to change the position when the medium P is discharged. A configuration of providing by fixing in the embodiment also includes a configuration in which the downstream side zone 44*b* is attachable to and detachable from the apparatus main body 12 so as to be assembled or replaced.

The upstream side zone 44*a* is provided with a regulatory wall 44*d* that projects in the +Z direction in the end portion on the −Y direction side, as the "upstream side end portion". The upstream side zone 44*a* is provided with an upstream side medium support surface 44*e* that receives the discharged medium P. The upstream side zone 44*a* is provided with a notch portion 44*f* at the center of the X-axis direction in the end portion on the +Y direction side.

A downstream side medium support surface 44*g* is provided on the top surface of the downstream side zone 44*b*. A guide portion 44*h* that projects toward the −Y direction side at a position corresponding to the notch portion 44*f* of the upstream side zone 44*a* is formed at the end portion of the downstream side zone 44*b* on the −Y direction side. A guide surface 44*j* is formed on the top surface of the guide portion 44*h*.

A drive shaft 46 that extends in the X-axis direction is rotatably attached to the pair of frames 44*c*. An end portion of the drive shaft 46 on the +X direction side is connected to a drive force transmitting unit 50 that transmits a drive force of the drive motor 48. The drive force transmitting unit 50 in the embodiment is configured of a plurality of gears (not illustrated) as an example and is configured to transmit the drive force of the drive motor 48 to the drive shaft 46. With the drive motor 48, as an example, a rotation direction, in which the upstream side zone 44*a* is moved from the retraction position to the advance position, is set as a forward rotation direction, and a rotation direction, in which the upstream side zone 44*a* is moved from the advance position to the retraction position, is set as a reverse rotation direction.

In the embodiment, a pair of drive gears 52 is fixed to the drive shaft 46 at an interval in the X-axis direction so as to rotate along with the drive shaft 46. Each of the drive gears 52 intermeshes with a rack 54. In the embodiment, the drive gears 52 and the racks 54 configure a rack and pinion mechanism.

A pair of side walls 44*k* that extends to the +Z-axis direction side is formed in both side portions of the upstream side zone 44*a* in the X-axis direction of the second medium receiving tray 44. A rotary shaft 56 that extends in the X-axis direction is attached to the pair of side walls 44*k*. In the embodiment, a part of the rotary shaft 56 is gripped on a back side of the rack 54.

A rotary shaft 58 that extends in the X-axis direction is rotatably attached to the pair of frames 44*c*. In the embodiment, a detection lever 60 is attached to a center portion of the rotary shaft 58 in the X-axis direction, specifically, a position corresponding to the guide surface 44*j* of the guide portion 44*h* in the X-axis direction. The detection lever 60 abuts the guide surface 44*j* in a case where the medium P is not placed in the second medium receiving tray 44.

When the medium P is placed in the second medium receiving tray 44, the detection lever 60 moves rotationally in a direction of separating from the guide surface 44*j* with the rotary shaft 58 as a rotary point, depending on a thickness of the placed media P. When a preset number of sheets are placed in the second medium receiving tray 44, the detection lever 60 moves rotationally by a predetermined amount. The rotary operation is detected by a detection sensor (not illustrated).

As a result, the detection sensor (not illustrated) detects that a set number of media P are placed in the second medium receiving tray 44. In this manner, a controller (not illustrated) disposed in the printer 10 issues an alarm for notifying that the predetermined number of media P are placed in the second medium receiving tray 44, that is, a stack height of the media P on the second medium receiving tray 44 reaches an upper limit, for example, based on detection information of the detection sensor (not illustrated), or the controller displays a message on a display panel of the operating unit 16. In addition, in a case where a stacked amount of the media P on the second medium receiving tray 44 reaches the upper limit, and in a case where the print job remains, the controller (not illustrated) pauses a print job temporarily or switches the discharge destination of the medium P to the first medium receiving tray 42.

Figure 17:
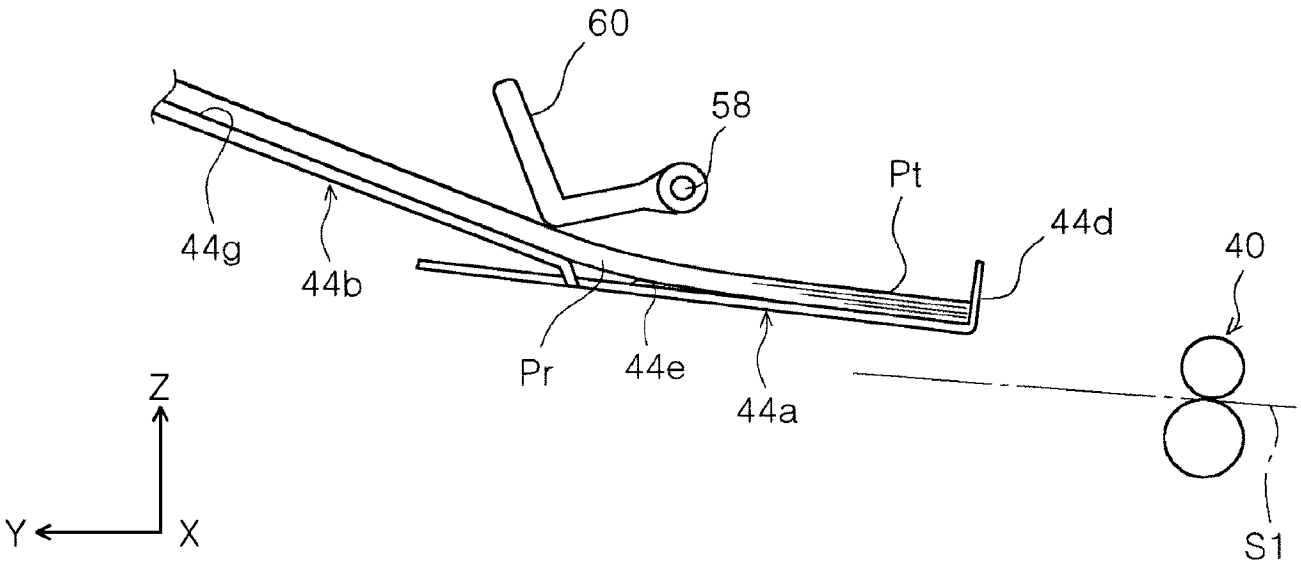
FIG. 17 is a sectional side view of a medium transport route for illustrating disposition of a detection lever.

When the upstream side zone 44*a* is positioned at the advance position, in the embodiment, an inclination of the upstream side medium support surface 44*e* of the upstream side zone 44*a* is equal to an inclination of the downstream side medium support surface 44*g* of the downstream side zone 44*b*; however, when the upstream side zone 44*a* is positioned at the retraction position, the upstream side medium support surface 44*e* has an inclination gentler than the inclination of the downstream side medium support surface 44*g*. Hence, as illustrated in FIG. 17, a bending portion Pr is formed to stacked media bundle Pt. When the detection lever 60 is disposed at a position that abuts the bending portion Pr, there is a concern that it is not possible to measure a stacked height of the media bundle Pt with accuracy; however, since the detection lever 60 is provided at a position that avoids the bending portion Pr, it is possible to measure the stacked height of the media bundle Pt with accuracy.

Figure 18:
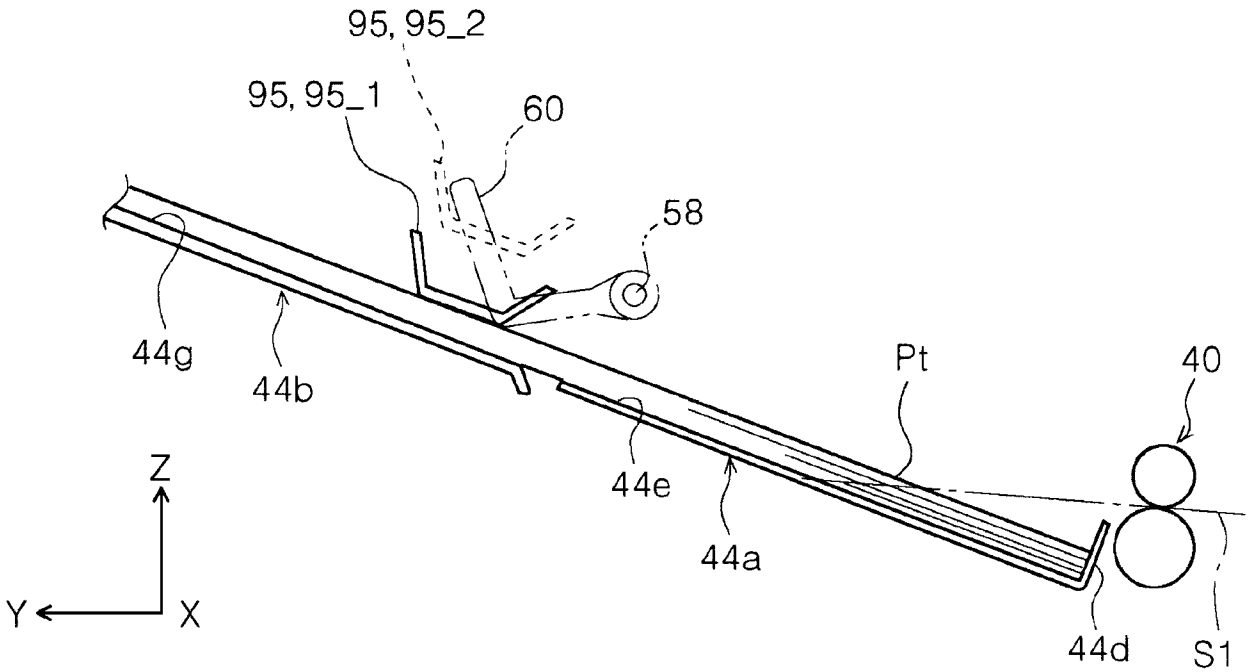
FIG. 18 is a sectional side view of the medium transport route in a case of including a holding member.

In addition, in order to detect the stacked height of the media bundle Pt with accuracy, it is also preferable to provide a holding member 95 that holds the media bundle Pt as illustrated in FIG. 18. The holding member 95 is provided to be capable of changing a position between a position (reference sign 95_1) at which the holding member 95 holds the media bundle Pt by a drive unit (not illustrated) and a position (reference sign 95_2) to which the holding member retracts from the media bundle Pt. The holding member 95 holds the media bundle Pt, and thereby it is possible for the detection lever 60 to detect the stacked height of the media bundle Pt with accuracy.

In particular, in a case of ink jet recording, the medium P absorbs ink and swells, and an air layer can be formed between media in the media bundle Pt. Therefore, there is a concern that it is not possible to detect the stacked height of the media bundle Pt with accuracy; however, the holding member 95 provided as described above makes it possible to detect the stacked height of the media bundle Pt with accuracy.

Since the swelling due to absorbing of ink by the medium P subsides as time elapses, the stacked height may be measured by the detection lever 60 after a predetermined time since the medium P has been discharged, instead of providing the holding member 95.

Although not illustrated, a detection sensor is also provided in the first medium receiving tray 42. When the predetermined sheets of media P are placed in the first medium receiving tray 42, a detection state of the detection sensor provided in the first medium receiving tray 42 changes. Consequently, the predetermined sheets of media P are detected to be placed in the first medium receiving tray 42, and a media discharge operation to the second medium receiving tray 44 is regulated. Specifically, a switching operation of the upstream side zone 44*a* from the retraction position to the advance position is regulated. Consequently, when the position of the upstream side zone 44*a* is switched from the retraction position to the advance position, it is possible to prevent the upstream side zone 44*a* from interfering with the medium P placed in the first medium receiving tray 42.

As illustrated in FIGS. 7 to 9, the pair of frames 44*c* is each provided with a first guide groove 62 and a second guide groove 64. The first guide groove 62 is formed as a downward inclined groove that descends toward the −Y direction side. The rotary shaft 56 is inserted into the first guide groove 62. When the rack 54 is driven by the drive gears 52, the rotary shaft 56 moves in the Y-axis direction in the first guide groove 62 along the first guide groove 62.

A guide pin 66 is inserted into the second guide groove 64. The guide pin 66 is configured to project in an outward direction of the second medium receiving tray 44 on the pair of side walls 44*k* of the second medium receiving tray 44, specifically, to project in the +X-axis direction from the side wall 44*k* on the +X-axis direction side and in the −X-axis direction from the side wall 44*k* on the −X-axis direction side.

The second guide groove 64 extends in the Y-axis direction overall. The second guide groove 64 is provided with a support portion 64*a* that supports the guide pin 66 in a state in which the upstream side zone 44*a* is positioned at the retraction position, an angle changing portion 64*b* that extends from the support portion 64*a* toward the −Y direction side and the −Z direction side and changes an angle of the upstream side zone 44*a*, and an advance/retraction portion 64*c* that extends from the angle changing portion 64*b* toward the −Y direction side and the −Z direction side. In the embodiment, an inclination angle to the −Z direction side in the angle changing portion 64*b* is set to be steeper than an inclination angle in the advance/retraction portion 64*c*.

Subsequently, switching of the position of the upstream side zone 44*a* between the retraction position and the advance position will be described with reference to FIGS. 7 to 9. FIG. 7 illustrates a state in which the upstream side zone 44*a* is positioned at the retraction position. In this state, the upstream side medium support surface 44*e* of the upstream side zone 44*a* is inclined in an upward direction (+Z-axis direction) toward a medium discharge direction (+Y-axis direction side) by an inclination angle θ1 with respect to the Y axis (horizontal). The rotary shaft 56 is positioned at an end portion of the first guide groove 62 on the −Y direction side, and thus the guide pin 66 is supported by the support portion 64*a* of the second guide groove 64.

In this state, the upstream side zone 44*a* is positioned on the more +Z direction side than a tangential line S1 at the nip position N1 (FIG. 10) of the discharge roller pair 40. When the upstream side zone 44*a* is positioned at the retraction position, the upstream side zone 44*a* does not block an advance direction of the medium P discharged by the discharge roller pair 40, and thus the discharged medium P is discharged toward the first medium receiving tray 42.

Subsequently, when a drive force (rotation in the forward rotation direction) of the drive motor 48 is transmitted to the drive gears 52 via the drive force transmitting unit 50, the rack 54 moves toward the −Y direction side as represented by an arrow A1 illustrated in FIG. 8. The rotary shaft 56 also moves toward the −Y direction side (refer to an arrow A2) in the first guide groove 62, along with the movement of the rack 54 toward the −Y direction side.

The movement of the rotary shaft 56 toward the −Y-axis direction side causes the upstream side zone 44*a* to move also toward the −Y-axis direction side. Hence, the guide pin 66 provided on the side wall 44*k* of the upstream side zone 44*a* also moves toward the −Y direction side from the support portion 64*a* of the second guide groove 64 and moves along the angle changing portion 64*b* (refer to an arrow A3). In this case, the guide pin 66 moves in the −Z-axis direction along the angle changing portion 64*b* from the support portion 64*a* in the Z-axis direction. As a result, the upstream side zone 44*a* moves rotationally in a clockwise direction in FIG. 8 with the rotary shaft 56 as a rotary point (refer to an arrow A4). In other words, the regulatory wall 44*d* of the upstream side zone 44*a* changes a position toward the −Z direction side and intersects the tangential line S1.

Subsequently, as illustrated in FIG. 9, when the rack 54 further moves toward the −Y-axis direction side (refer to an arrow A5), the rotary shaft 56 further moves toward the −Y direction side in the first guide groove 62 (refer to an arrow A6) so as to be positioned at an end portion of first guide groove 62 on the −Y direction side. In this state, the guide pin 66 moves to the advance/retraction portion 64*c* through the angle changing portion 64*b* in the second guide groove 64 and is positioned at an end portion of the advance/retraction portion 64*c* on the −Y-axis direction side (refer to an arrow A7). A position of the upstream side zone 44*a* illustrated in FIG. 9 is the advance position of the upstream side zone 44*a*.

As a result, the upstream side zone 44*a* further moves toward the −Y-axis direction side from the position in FIG. 8 and comes into a state in FIG. 9 (refer to an arrow A8). In this state, the upstream side medium support surface 44*e* of the upstream side zone 44*a* comes into an inclined state in the upward direction (+Z-axis direction) toward the medium discharge direction (+Y-axis direction side) by an inclination angle θ2 with respect to the Y axis. In the embodiment, the inclination angle θ2 is set to an angle larger than the inclination angle θ1. Hence, the upstream side medium support surface 44*e* has a gentler inclined posture in a case of being positioned at the retraction position, compared with a case of being positioned at the advance position.

In the embodiment, the upstream side zone 44*a* is moved by switching an angle from the inclination angle θ1 to the inclination angle θ2 larger than the inclination angle θ1, and thereby it is possible to switch the position of the upstream side zone 44*a* from the retraction position to the advance position through a shorter movement distance than a movement distance of the upstream side zone at the inclination angle θ1 as is.

As illustrated in FIG. 10, when the upstream side zone 44*a* is positioned at the advance position, the regulatory wall 44*d* of the end portion of the upstream side zone 44*a* on the −Y-axis direction side is positioned on the more −Z direction side than the nip position N1 of the discharge roller pair 40 and the tangential line S1 that passes through the nip position N1 in the Z-axis direction, that is, the regulatory wall 44*d* that configures the end portion of the upstream side zone 44*a* on the upstream side is positioned below the nip position N1 in the vertical direction.

The description that "the upstream side end portion (regulatory wall 44*d* in the embodiment) of the upstream side zone 44*a* is positioned below the nip position N1 in the vertical direction" is provided by focusing only on the positional relationship in the vertical direction. Specifically, this also includes a state in which the upstream side end portion of the upstream side zone 44*a* is positioned right below the nip position N1, in addition to a state in which the upstream side end portion of the upstream side zone 44*a* is positioned below in the vertical direction although the upstream side end portion of the upstream side zone is displaced in the Y-axis direction with respect to the nip position N1 as described in the embodiment and means that any positional relationship between the upstream side end portion of the upstream side zone 44*a* and the nip position N1 in the Y-axis direction may be employed. Hence, in a range in which the upstream side medium support surface 44*e* can receive the medium P, any relationship between the upstream side end portion of the upstream side zone 44*a* and the nip position N1 in the X-axis direction may be employed.

As described above, when the upstream side zone 44*a* is positioned at the advance position, the upstream side zone 44*a* blocks the discharge route P-2 (also refer to FIG. 3) of the medium P. Consequently, the medium P discharged from the discharge roller pair 40 comes into contact with the upstream side medium support surface 44*e* and is guided in the +Y-axis direction by the upstream side medium support surface 44*e*. A two-dot chain line assigned with the reference sign P-2 in FIG. 10, illustrates a part of the discharge route P-2 of the medium P, specifically, only a region in the vicinity of the discharge roller pair 40.

The discharge route P-2 in FIGS. 3 and 10 as described above varies depending on the rotation speed of the discharge roller pair 40, a type of medium P, a landing state of ink to the medium, or the like. Hence, it is preferable that the discharge route P-2 in a case where the most remarkable falling down of the medium occurs be assumed to determine the advance position of the upstream side zone 44*a*. For example, when recording with the most remarkable wetting of ink is performed on a medium having the lowest stiffness of types of media assumed to be used, and the discharge route P-2 in a case of discharging the medium at the lowest speed is assumed so as to determine the advance position of the upstream side zone 44*a*, it is possible to stack the media in the second medium receiving tray 44.

As described in the embodiment, when the upstream side end portion of the upstream side zone 44*a* is advanced to a position at which the upstream side end portion approaches the discharge roller pair 40, the media can always be stacked in the second medium receiving tray 44.

Here, as illustrated in FIGS. 9 and 10, the inclination (inclination angle θ2) of the upstream side medium support surface 44*e* of the upstream side zone 44*a* at the advance position in the embodiment is set to be equal to the inclination of the downstream side medium support surface 44*g* of the downstream side zone 44*b*. The equal inclination in the embodiment is not limited to the completely same inclination angle, and a deviation of an angle is allowed to the extent that the medium P is transported from the upstream side medium support surface 44*e* to the downstream side medium support surface 44*g* without being caught on the end portion of the downstream side zone 44*b* on the −Y direction side.

With reference to FIGS. 7 to 9, the position of the regulatory wall 44*d* of the upstream side zone 44*a* is positioned on the more −Y direction side in the Y-axis direction, in a case where the upstream side zone 44*a* is positioned at the advance position than in a case of being positioned at the retraction position, that is, the regulatory wall 44*d* is positioned at a position closer to the discharge roller pair 40 in a case of being positioned at the advance position than in a case of being positioned at the retraction position, and thereby the upstream side medium support surface 44*e* can be closer to the discharge roller pair 40. Therefore, it is possible to reliably place the medium P to be discharged on the upstream side medium support surface 44*e*.

As illustrated in FIGS. 4, 6, and 10, in the embodiment, the guide portion 44*h* that projects toward the notch portion 44*f* of the upstream side zone 44*a* is formed at the end portion of the downstream side zone 44*b* on the −Y-axis direction side. In the embodiment, an inclination of the guide surface 44*j* of the guide portion 44*h* is set to be equal to the inclination (inclination angle) of the downstream side medium support surface 44*g*. The inclination angle of the guide surface 44*j* is not only completely equal to the inclination angle of the downstream side medium support surface 44*g*, but also a deviation in angle is allowed to the extent that it is possible to smoothly transport the medium P.

In the embodiment, when the medium P is discharged from the discharge roller pair 40 in a state in which the upstream side zone 44*a* is positioned at the advance position, the medium P is guided toward the +Y-axis direction along the upward-inclined upstream side medium support surface 44*e*. With reference to FIG. 6, in a state in which the upstream side zone 44*a* is positioned at the advance position, the guide portion 44*h* of the downstream side zone 44*b* moves out from the notch portion 44*f* of the upstream side zone 44*a*.

In the embodiment, the notch portion 44*f* of the upstream side zone 44*a* is configured to cut out a part of the upstream side medium support surface 44*e*, and thus the upstream side medium support surface 44*e* are formed in both side portions of the notch portion 44*f* in the X-axis direction. When the medium P is guided toward the +Y-axis direction side along the upstream side medium support surface 44*e* and reaches a position of the notch portion 44*f* in the Y-axis direction, the medium P is continuously guided toward the +Y-axis direction while being supported by regions that are positioned on both sides of the notch portion 44*f* in the X-axis direction in the upstream side medium support surface 44*e*.

When the medium P reaches the end portion of the upstream side medium support surface 44*e* on the +Y-axis direction side, the center portion of the medium P in the width direction (X-axis direction) comes into contact with the guide surface 44*j* of the guide portion 44*h* of the downstream side zone 44*b*. Then, while being supported by the guide surface 44*j*, the medium P is guided in the +Y-axis direction. Further, when the medium P is sent toward the +Y-axis direction side, the medium passes over the guide surface 44*j* so as to be guided to the downstream side medium support surface 44*g*.

As a result, the medium P discharged from the discharge roller pair 40 is supported by the second medium receiving tray 44, specifically, by the upstream side medium support surface 44*e* of the upstream side zone 44*a* positioned at the advance position and the downstream side medium support surface 44*g* of the downstream side zone 44*b*. In the embodiment, the end portion of the upstream side zone 44*a* on the −Y direction side is provided with the regulatory wall 44*d*, and thus it is possible to regulate sliding-down of the discharged medium P in the upward inclined second medium receiving tray 44 on the +Y-direction side.

Here, when the rotation direction of the drive motor 48 is switched from the forward rotation direction to the reverse rotation direction, it is possible to move the upstream side zone 44*a* from the advance position to the retraction position. Specifically, the upstream side zone 44*a* moves in the reverse direction through a moving route from the retraction position to the advance position of the upstream side zone 44*a* described above, and the position of the upstream side zone is switched from the advance position to the retraction position. As an example, the rotation direction of the drive motor 48 is appropriately switched, and thereby it is possible to appropriately switch a state of the upstream side zone 44*a* between a state of being positioned at the retraction position and a state of being positioned at the advance position.

For example, the state of the second medium receiving tray 44 may be switched such that the plurality of media P are discharged alternately to the first medium receiving tray 42 and the second medium receiving tray 44, or the predetermined number of media P are discharged to one of the first medium receiving tray 42 and the second medium receiving tray 44 and then are discharged to the other medium receiving tray. In other words, a discharge destination medium tray may be appropriately switched depending on discharge of the medium P.

In the embodiment, in FIGS. 4 and 9, inclinations of the upstream side medium support surface 44*e* and the downstream side medium support surface 44*g* of the second medium receiving tray 44 in a state in which the upstream side zone 44*a* of the second medium receiving tray 44 is positioned at the advance position are set to be equal to the inclination (inclination angle) of the medium support surface 42*a* of the first medium receiving tray 42. In the embodiment, the equal inclination of the upstream side medium support surface 44*e* and the downstream side medium support surface 44*g* and the medium support surface 42*a* includes not only the complete equal state but also a deviation in angle due to component accuracy or an attachment error occurring during assembly.

In the embodiment, the position of the second medium receiving tray 44 is appropriately switched between the retraction position and the advance position, and thereby it is possible to switch the discharge destination of the medium P that is discharged from the discharge roller pair 40 between the first medium receiving tray 42 and the second medium receiving tray 44. As a result, since there is no need to provide the discharge roller pair 40 for each medium receiving tray 42 or 44, and there is no need to synchronize the plurality of discharge roller pairs 40 with each other, it is possible to suppress a reduction in paper feed accuracy or printing accuracy. Additionally, since it is possible to configure the discharge roller pair 40 by one set, it is possible to sort the media P to be discharged, in a simple configuration, and it is possible to configure the medium discharge device 18 in a small size and at low costs.

The discharge roller pair 40 shares a common drive source with the other transport rollers, and thus the discharge roller pair rotates reversely when duplex printing is performed. In a case where the discharge roller pair 40 rotates reversely in a state in which the upstream side zone 44*a* is positioned at the advance position, there is a concern that an upstream end of the medium P discharged to the second medium receiving tray 44 will touch the discharge roller pair 40 and be drawn into the apparatus. In particular, such a problem easily occurs in a case where the inclination angle of the second medium receiving tray 44 is a steep angle. Hence, in a case where the discharge roller pair 40 rotates reversely, it is preferable that the position of the second medium receiving tray 44 be switched to the retraction position.

Figure 19:
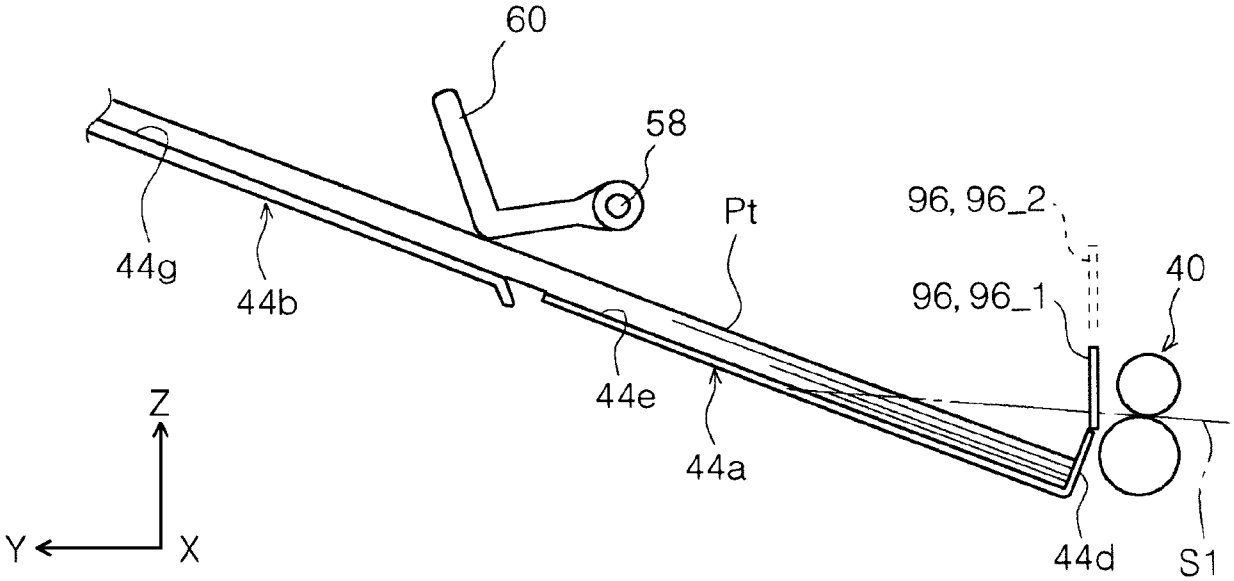
FIG. 19 is a sectional side view of the medium transport route in a case of including a shutter.

Otherwise, it is preferable to provide a shutter member 96 as illustrated in FIG. 19. The shutter member 96 is provided to be capable of changing a position between a position (reference sign 96_1) at which the shutter member blocks the discharge route of the medium P by a drive unit (not illustrated) and a position (reference sign 96_2) at which the shutter member opens the discharge route of the medium P. In an example of FIG. 19, the shutter member 96 intersects the tangential line S1 at the nip position N1 of the discharge roller pair 40 at a position at which the shutter member blocks the discharge route of the medium P.

The shutter member 96 can prevent the problem from arising in that the upstream end of the medium P discharged to the second medium receiving tray 44 touches the discharge roller pair 40 and be drawn into the apparatus.

The shutter member 96 may be a rigid body or may be formed of a flexible member such as a film-shaped member.

To summarize the above description, the medium discharge device 18 includes the discharge roller pair 40 that discharges the medium, the first medium receiving tray 42 that receives the discharged medium, and the second medium receiving tray 44 that is provided on the more +Z direction side than the first medium receiving tray 42 in the Z-axis direction and receives the discharged medium P. The second medium receiving tray 44 is capable of changing the position between the advance position for receiving the medium P, which is discharged, by causing at least the upstream side zone 44*a* of the tray including the end portion on the −Y-axis direction side in the Y-axis direction to advance to the discharge route P-2 (FIGS. 3 and 10) of the medium P from the discharge roller pair 40 toward the first medium receiving tray 42 and the retraction position to which the upstream zone retracts from the passing route.

In the configuration described above in which the first medium receiving tray 42 and the second medium receiving tray 44 are provided, at least the upstream side zone 44*a* of the second medium receiving tray 44 changes a position, and thereby it is possible to switch the discharge destination of the medium P. In other words, since there is no need to employ a configuration in which all of the trays including the first medium receiving tray 42 and the second medium receiving tray 44 move upward and downward, and there is no need to employ a configuration in which the discharge roller pair 40 moves upward and downward, it is possible to provide the medium discharge device 18 that is capable of sorting media P to be discharged, in a simpler configuration, in a small size, and at low costs.

The discharge roller pair 40 is configured of the discharge roller pair that nips and discharges the medium P. When the upstream side zone 44*a* of the second medium receiving tray 44 is positioned at the advance position, the upstream side zone 44*a* intersects the tangential line S1 at the nip position N1 of the discharge roller pair 40. According to the configuration, it is possible to more reliably place the medium P to be discharged from the discharge roller pair 40 in the second medium receiving tray 44.

The discharge roller pair 40 is configured of the discharge roller pair that nips and discharges the medium P. When the upstream side zone 44*a* of the second medium receiving tray 44 is positioned at the advance position, the upstream side end portion is positioned on the more −Z direction side in the Z-axis direction than the nip position N1 of the discharge roller pair 40. According to the configuration, it is possible to more reliably place the medium P to be discharged from the discharge roller pair 40 in the second medium receiving tray 44.

The upstream side medium support surface 44*e* provided in the upstream side zone 44*a* of the second medium receiving tray 44 is formed into the inclined surface ascending toward the +Z direction side in the +Y-axis direction with respect to the horizontal, and the inclination angle of the inclined surface with respect to the horizontal is larger in the case where the upstream side zone 44*a* is positioned at the advance position than in the case where the upstream side zone is positioned at the retraction position. According to the configuration, it is possible to secure a wide space below the upstream side zone 44*a* in the case where the upstream side zone 44*a* is positioned at the retraction position, and thus it is possible to suppress interference of the upstream side zone 44*a* with the discharge of the medium P to the first medium receiving tray 42.

When the upstream side zone 44*a* of the second medium receiving tray 44 is positioned at the advance position, the upstream side medium support surface 44*e* and the downstream side medium support surface 44*g* provided in the second medium receiving tray 44 and the medium support surface 42*a* provided in the first medium receiving tray 42 are all inclined upward in the same degree toward the +Y-axis direction. In the embodiment, the first medium receiving tray 42 is disposed at the inclination (angle) suitable for placing the medium P, and the second medium receiving tray 44 and the first medium receiving tray 42 are inclined at the same degree. Therefore, it is possible to suitably place the discharged medium P.

The second medium receiving tray 44 is configured to have the upstream side zone 44*a* and the downstream side zone 44*b* that is provided to be fixed on the more +Y-axis direction than the advanceable/retractable upstream side zone 44*a* between the retraction position and the advance position. According to the configuration, there is no need for the entire second medium receiving tray 44 to perform a position changing movement, and thus it is possible to avoid an increase in configuration of the apparatus.

When the upstream side zone 44*a* of the second medium receiving tray 44 is positioned at the advance position, the upstream side medium support surface 44*e* provided in the upstream side zone 44*a* and the downstream side medium support surface 44*g* provided in the downstream side zone 44*b* are both inclined toward the +Z-axis direction in the +Y-axis direction with respect to the horizontal in the same degree. According to the configuration, it is possible to appropriately stack the media P to be discharged, in a natural shape.

The guide portion 44*h* is provided to guide the medium P from the upstream side medium support surface 44*e* provided in the upstream side zone 44*a* to the downstream side medium support surface 44*g* provided in the downstream side zone 44*b*, when the upstream side zone 44*a* is positioned at the advance position. According to the configuration, it is possible to smoothly advance the medium P from the upstream side zone 44*a* to the downstream side zone 44*b*.

The guide surface 44*j*, on which the guide portion 44*h* guides the medium P, is inclined at the same degree as the downstream side medium support surface 44*g* provided in the downstream side zone 44*b*. According to the configuration, it is possible to smoothly advance the medium P, when the medium advances from the guide surface 44*j* to the downstream side zone 44*b*.

The upstream side end portion of the second medium receiving tray 44 is provided with the regulatory wall 44*d* that regulates a tail end of the discharged medium P. According to the configuration, it is possible to suppress sliding-down of the medium P from the second medium receiving tray 44.

The printer 10 includes the recording head 38 that performs recording on the medium P and the medium discharge device 18 that discharges the medium P on which the recording has been performed by the recording head 38.

Second Embodiment

A second embodiment of the medium discharge device in FIGS. 11 to 13 is described. A medium discharge device 68 in the embodiment includes a first medium receiving tray 70 and a plurality of second medium receiving trays 72 and 74. In FIGS. 11 to 13, configurations other than the medium discharge device 68, the discharge roller pair 40, the first medium receiving tray 70, and the plurality of second medium receiving trays 72 and 74 are omitted. In the embodiment, a configuration of the first medium receiving tray 70 is the same as the configuration in the first embodiment, and thus the description thereof is omitted.

The second medium receiving tray 72 in the embodiment is different from the second medium receiving tray 44 in the first embodiment, and the entire tray is configured to change a position thereof between the retraction position (a two-dot chain line portion assigned with a reference sign 72-1 in FIG. 12) and the advance position (a solid line portion assigned with a reference sign 72 in FIG. 12).

The second medium receiving tray 74 in the embodiment is disposed in between the first medium receiving tray 70 and the second medium receiving tray 72 in the Z-axis direction. The second medium receiving trays 72 and 74 in the embodiment are each configured to be capable of switching a position between the retraction position and the advance position.

In the embodiment, the first medium receiving tray 70 and the plurality of second medium receiving trays 72 and 74 are radially disposed. Radial disposition thereof is specifically described. A gap between the first medium receiving tray 70 and the second medium receiving tray 72 is set to be narrowed as the trays approach the discharge roller pair 40 and to be widened as the trays are separated from the discharge roller pair 40. Similarly, a gap between the second medium receiving tray 72 and the second medium receiving tray 74 is set to be narrowed as the trays approach the discharge roller pair 40 and to be widened as the trays are separated from the discharge roller pair 40.

In other words, the gaps between the trays are set to be narrowed on a side on which the trays approach the discharge roller pair 40 and to be widened on a side on which the trays are separated from the discharge roller pair. Hence, since a gap between adjacent trays of the first medium receiving tray 70 and the plurality of second medium receiving trays 72 and 74 is widened toward the discharge direction in the configuration, it is possible to easily insert a hand of a user between the trays 70, 72, and 74, and it is possible to easily take out the medium P discharged to the trays 70, 72, and 74.

FIG. 11 illustrates a state in which the second medium receiving trays 72 and 74 are both positioned at the retraction position. In this state, since the second medium receiving trays 72 and 74 do not block a discharge route P-4 of the medium P discharged by the discharge roller pair 40, the medium P is discharged toward the first medium receiving tray 70 and is supported on the first medium receiving tray 70. A two-dot chain line assigned with a reference sign P-4 represents a discharge route of the medium P discharged toward the first medium receiving tray 70 from the discharge roller pair 40.

Subsequently, as illustrated in FIG. 12, a position of the second medium receiving tray 72 is switched between the retraction position and the advance position (refer to an arrow A9 and an arrow A10). A switching operation from the retraction position to the advance position in the second medium receiving tray 72 is the same as the operation in the first embodiment. The two-dot chain line portion assigned with the reference sign 72-1 in FIG. 12 represents the second medium receiving tray 72 positioned at the retraction position, and the solid line portion assigned with the reference sign 72 represents the second medium receiving tray 72 positioned at the advance position.

When the second medium receiving tray 72 is positioned at the advance position, at least a part of the second medium receiving tray 72 is positioned on the more −Z direction side than the nip position N1 of the discharge roller pair 40. In this state, when the discharge roller pair 40 discharges the medium P, the second medium receiving tray 72 blocks the discharge route P-4 (FIG. 11) of the medium P toward the first medium receiving tray 70. As a result, the medium P discharged by the discharge roller pair 40 is not supported by the first medium receiving tray 70 but is supported by the second medium receiving tray 72 so as to be placed in the second medium receiving tray 72. A two-dot chain line assigned with a reference sign P-5 represents a discharge route of the medium P discharged toward the second medium receiving tray 72 from the discharge roller pair 40.

As illustrated in FIG. 13, a position of the second medium receiving tray 74 is switched between the retraction position and the advance position (refer to an arrow A11). In the embodiment, the second medium receiving tray 74 is configured to retract and advance between the retraction position and the advance position by a drive motor and a drive force transmitting unit (both not illustrated). Specifically, similarly to the first embodiment, as an example, the second medium receiving tray 74 is configured to be moved by the rack and pinion. A two-dot chain line portion assigned with a reference sign 74-1 in FIG. 13 represents the second medium receiving tray 74 positioned at the retraction position, and a solid line portion assigned with the reference sign 74 represents the second medium receiving tray 74 positioned at the advance position.

When the second medium receiving tray 74 is positioned at the advance position, at least a part of the second medium receiving tray 74 is positioned on the more −Z direction side than the nip position N1 of the discharge roller pair 40. In this state, when the discharge roller pair 40 discharges the medium P, the second medium receiving tray 74 blocks the discharge route P-4 (FIG. 11) of the medium P toward the first medium receiving tray 70. As a result, the medium P discharged by the discharge roller pair 40 is not supported by the first medium receiving tray 70 but is supported by the second medium receiving tray 74 so as to be placed in the second medium receiving tray 74. A two-dot chain line assigned with a reference sign P-6 represents a discharge route of the medium P discharged toward the second medium receiving tray 74 from the discharge roller pair 40.

In the embodiment, the positions of the second medium receiving trays 72 and 74 are appropriately switched between the retraction position and the advance position, and thereby it is possible to switch the discharge destination of the medium P that is discharged from the discharge roller pair 40 to any one of the plurality of discharge trays. As a result, it is possible to sort the media P to be discharged in a simple configuration, and it is possible to configure the medium discharge device 68 in a small size and at low costs.

The medium discharge device 68 in the embodiment includes the plurality of second medium receiving trays 72 and 74. The first medium receiving tray 70 and the second medium receiving trays 72 and 74 are disposed radially toward the downstream side in the discharge direction, in a side view of the discharge route of the medium P. According to the configuration, it is possible to save a space for disposing the first medium receiving tray 70 and the second medium receiving trays 72 and 74 on the downstream side in the discharge direction, and the configuration can contribute to miniaturization of the apparatus.

Modification Embodiment of Second Embodiment

The second medium receiving tray 72 in the embodiment has the configuration in which the entire tray moves rotationally between the retraction position and the advance position so as to retract and advance; however, instead of the configuration, similarly to the first embodiment, the second medium receiving tray 72 may have a configuration in which the upstream side zone and the downstream side zone are provided on the tray, and only the upstream side zone is caused to retract or advance between the retraction position and the advance position.

Third Embodiment

A third embodiment of the medium discharge device is described with reference to FIGS. 14 to 16. The embodiment differs from the first embodiment and the second embodiment in that a driven roller **76*b* is provided to be capable of changing a position thereof around a drive roller 76*a* in a discharge roller pair 76**, and the discharge route of the medium P is changed.

A medium discharge device 78 in the embodiment includes the discharge roller pair 76, a first medium receiving tray 80, second medium receiving trays 82 and 84, and a driven roller driving unit 86. In the embodiment, the second medium receiving trays 82 and 84 are different from those of the second embodiment and are fixed to the medium discharge device 78. Also in the embodiment, similarly to the second embodiment, the first medium receiving tray 80 and the second medium receiving trays 82 and 84 may be radially disposed.

The discharge roller pair 76 includes the drive roller **76*a* as a "first roller" and the driven roller 76*b* as a "second roller". The driven roller driving unit 86 includes a drive motor 88, gears 90A, 90B, and 90C, and a swinging arm 92, as an example. The gear 90A is attached to a drive shaft of the drive motor 88 and functions as a drive gear. The gear 90C is connected to one end of the swinging arm 92, and the driven roller 76*b* is rotatably attached to the other end thereof. The swinging arm 92** is configured to be rotatable with one end side as a rotary point.

As illustrated in FIGS. 14 to 16, when the drive motor 88 rotates, the gears 90A, 90B, and 90C rotate sequentially, and the swinging arm 92 moves rotationally with one end side as a fulcrum. The driven roller **76*b* moves rotationally around the drive roller 76*a* due to the rotational movement. As a result, it is possible to appropriately change the nip position in the discharge roller pair 76**.

In FIG. 14, the nip position in the discharge roller pair 76 is set as N2. A dot-and-dash line assigned with a reference sign S2 represents a tangential line at the nip position N2 of the discharge roller pair 76. As illustrated in FIG. 14, the tangential line S2 does not intersect the second medium receiving trays 82 and 84 and extends toward the first medium receiving tray 80. The medium P, which is nipped by the discharge roller pair 76 at the nip position N2 so as to be discharged, is discharged to the first medium receiving tray 80 along a route represented by a reference sign P-7.

Subsequently, the drive motor 88 is rotated as illustrated in FIG. 15, and the swinging arm 92 is caused to swing such that the nip position in the discharge roller pair 76 is switched from the nip position N2 to the nip position N3. Consequently, a tangential line at the nip position of the discharge roller pair 76 is changed from the tangential line S2 to a tangential line S3. The tangential line S3 extends toward the +Z direction of the second medium receiving tray 82 through the nip position N3. The medium P, which is nipped by the discharge roller pair 76 at the nip position N3 so as to be discharged, is discharged to the second medium receiving tray 82 along a route (two-dot chain line) represented by a reference sign P-8.

In FIG. 16, when the nip position in the discharge roller pair 76 is switched from the nip position N3 to the nip position N4, the tangential line at the nip position of the discharge roller pair 76 is changed from the tangential line S3 to a tangential line S4. The tangential line S4 passes through the nip position N4, does not intersect the second medium receiving tray 82, and extends toward the second medium receiving tray 84. The medium P, which is nipped by the discharge roller pair 76 at the nip position N4 so as to be discharged, is discharged to the second medium receiving tray 84 along a route (two-dot chain line) represented by a reference sign P-9.

In the embodiment, the position of the driven roller 76*b* changes around the drive roller 76*a*, and thereby it is possible to change the discharge direction of the medium P. Consequently, it is possible to switch the discharge destination of the medium P that is discharged from the discharge roller pair 76 to any one of the plurality of medium receiving trays 80, 82, and 84.

Here, when a configuration in which the position of the drive roller 76*a* changes around the driven roller 76*b* is employed, a unit that transmits a drive force from a drive source (not illustrated) to the drive shaft of the drive roller 76*a* and a drive shaft also needs to change a position thereof along with the position change of the drive roller 76*a*, and thus a configuration of the apparatus is complicated. By comparison, in the embodiment, since a configuration in which the position of the driven roller 76*b* changes around the drive roller 76*a* is employed, it is possible to more simplify the configuration in which the position of the driven roller 76*b* changes with respect to the drive roller 76*a*, compared with the configuration in which the position of the drive roller 76*a* changes around the driven roller 76*b*. As a result, it is possible to sort the media P to be discharged, in a simple configuration, and it is possible to configure the medium discharge device 78 in a small size and at low costs.

The medium discharge device 78 includes the discharge roller pair 76 that discharges the medium P, the first medium receiving tray 80 that receives the medium P discharged by the discharge roller pair 76, and the second medium receiving trays 82 and 84 that are provided on the more +Z direction side than the first medium receiving tray 80 in the Z-axis direction and receives the medium P discharged by the discharge roller pair 76. The discharge roller pair 76 has the drive roller 76*a* and the driven roller 76*b* that is provided to be capable of changing a position thereof around the drive roller 76*a* and nips the medium P in cooperation with the drive roller 76*a*, the driven roller 76*b* changes a position thereof around the drive roller 76*a*, and thereby the discharge destination of the medium P is switched to any one of the first medium receiving tray 80 and the second medium receiving trays 82 and 84.

When the driven roller 76*b* changes the position around the drive roller 76*a*, the discharge direction of the medium P changes by the drive roller 76*a* and the driven roller 76*b*. According to the configuration, such performance causes the discharge destination of the medium P to be switched to any one of the first medium receiving tray 80 and the second medium receiving trays 82 and 84, and thus it is possible to configure the medium discharge device 78 that is capable of sorting the media P to be discharged, in a simpler configuration, in a smaller size, and at lower costs, compared with a configuration in which the entire discharge roller pair 76 moves upward and downward.

In addition, in the embodiment, the first medium receiving trays 42, 70, and 80 and the second medium receiving trays 44, 72, 74, 82, and 84 are applied to the ink jet printer as an example of the recording apparatus; however, the medium receiving trays can be applied to another common liquid ejecting apparatus.

Here, examples of the liquid ejecting apparatus are not limited to recording apparatuses such as a printer, a copy machine, and a facsimile in which an ink jet type recording head is used, ink is ejected from the recording head, and recording is performed on a recording medium, but include an apparatus in which, instead of the ink, a liquid corresponding to an application is ejected from a liquid ejecting head corresponding to the ink jet type recording head on an ejecting medium corresponding to the recording medium and the liquid is attached to the ejecting medium.

Examples of liquid ejecting heads include, in addition to the recording head, a color material ejecting head that is used in manufacturing a color filter of a liquid crystal display or the like, an electrode material (conductive paste) ejecting head that is used in forming electrodes of an organic EL display, a field emission display (FED), or the like, a bioorganic material ejecting head that is used in manufacturing a biochip, a sample ejecting head as an accuracy pipette, or the like.

The disclosure is not limited to the examples, various modifications can be performed within a range of the disclosure described in What is claimed is, and it is needless to say that the modifications are also included in the range of the disclosure.

What is claimed is:

1. A medium discharge device comprising:

a discharge unit that discharges a medium;

a first medium receiving tray that receives the medium discharged by the discharge unit;

a second medium receiving tray that is provided above the first medium receiving tray in a vertical direction and receives the medium discharged by the discharge unit;

a geared rack mechanically connected to the second medium receiving tray; and a drive gear configured to engage the geared rack to cause the geared rack to move substantially horizontally between an upstream side and a downstream side, wherein:

the first medium receiving tray is fixed at a same position;

the second medium receiving tray is capable of changing a position between an advance position and a retraction position;

when the second medium receiving tray is in the advance position, an upstream zone of the second medium receiving tray is advanced to a passing route of the medium being discharged from the discharge unit, such that the medium discharged from the discharge unit is to be received by the second medium receiving tray;

when the second medium receiving tray is in the retraction position, the upstream zone of the second medium receiving tray is retracted away from the passing route, such that the medium discharged from the discharge unit is to be received by the first medium receiving tray; and the second medium receiving tray moves at least partially horizontally during a position change between the advance position and the retraction position, when the geared rack is moved to the upstream side, the second medium receiving tray is in the advance position, and an upstream zone of the second medium receiving tray is advanced to a passing route of the medium being discharged from the discharge unit, such that the medium discharged by the discharge unit is to be received by the second medium receiving tray; and when the geared rack is moved to the downstream side, the second medium receiving tray is in the retraction position, and the upstream zone of the second medium receiving tray is retracted away from the passing route, such that the medium discharged by the discharge unit is to be received by the first medium receiving tray.

2. The medium discharge device according to claim 1, wherein the second medium receiving tray is configured to have a downstream zone that is provided to be fixed on a downstream side of the advanceable/retractable upstream zone in the medium discharge direction.

3. The medium discharge device according to claim 2, wherein, when the upstream zone of the second medium receiving tray is positioned at the advance position, a medium support surface provided in the upstream zone and a medium support surface provided in the downstream zone are both inclined upward in the same degree with respect to a horizontal toward the medium discharge direction.

4. The medium discharge device according to claim 1, wherein the discharge unit is configured of a discharge roller pair that nips and discharges the medium, and wherein, when the upstream zone of the second medium receiving tray is positioned at the advance position, the upstream zone intersects a tangential line at a nip position of the discharge roller pair.

5. The medium discharge device according to claim 1, wherein the discharge unit is configured of a discharge roller pair that nips and discharges the medium, and wherein, when the upstream zone of the second medium receiving tray is positioned at the advance position, the upstream side end portion is positioned below a nip position of the discharge roller pair in the vertical direction.

6. The medium discharge device according to claim 1, wherein a position of the upstream side end portion of the upstream zone in the medium discharge direction is on a more upstream side in the medium discharge direction in a case where the upstream zone is positioned at the advance position than in a case where the upstream zone is positioned at the retraction position.

7. The medium discharge device according to claim 1, wherein a medium support surface provided in the upstream zone of the second medium receiving tray is formed into an upward inclined surface toward the medium discharge direction with respect to a horizontal, and wherein an inclination angle of the inclined surface with respect to the horizontal is larger in a case where the upstream zone is positioned at the advance position than in a case where the upstream zone is positioned at the retraction position.

8. The medium discharge device according to claim 1, wherein, when the upstream zone of the second medium receiving tray is positioned at the advance position, a medium support surface provided in the second medium receiving tray and a medium support surface provided in the first medium receiving tray are both inclined upward in the same degree toward the medium discharge direction.

9. The medium discharge device according to claim 1, wherein the upstream side end portion of the second medium receiving tray is provided with a regulatory wall that regulates a position of an upstream side end portion of a discharged medium.

10. The medium discharge device according to claim 1, wherein a plurality of the second medium receiving trays are provided.

11. The medium discharge device according to claim 1, wherein the first medium receiving tray and the second medium receiving tray are disposed radially toward a downstream side in a discharge direction, in a side view of the passing route.

12. A recording apparatus comprising:

a recording unit that performs recording on a medium; the medium discharge device according to claim 1 which discharges a medium on which recording has been performed by the recording unit.

* * * * *